US008079169B2

(12) United States Patent
Gregg

(10) Patent No.: US 8,079,169 B2
(45) **Date of Patent: *Dec. 20, 2011**

(54) TAKE-DOWN RIFLES INCLUDING A CALIBER EXCHANGE SYSTEM

(75) Inventor: James P. Gregg, Houston, TX (US)

(73) Assignee: James P. Gregg, Houston, TX (US)

( * ) Notice: Subject to any disclaimer, the term of this patent is extended or adjusted under 35 U.S.C. 154(b) by 364 days.

This patent is subject to a terminal disclaimer.

(21) Appl. No.: 12/381,928

(22) Filed: Mar. 18, 2009

(65) Prior Publication Data

US 2009/0277067 A1 Nov. 12, 2009

(51) Int. Cl.
*F41A 21/00* (2006.01)

(52) U.S. Cl. ..... 42/75.03; 42/71.01

(58) Field of Classification Search ..... 42/71.01, 42/75.01, 75.02, 75.03
See application file for complete search history.

(56) References Cited

U.S. PATENT DOCUMENTS

| | | | | |
|---|---|---|---|---|
| 2,145,054 | A | 1/1939 | Mossberg | |
| 2,339,331 | A | 5/1941 | Grigg | |
| 2,481,548 | A * | 9/1949 | Waltke, Jr. | 89/174 |
| 2,497,861 | A | 2/1950 | Brown | |
| 2,589,912 | A | 3/1952 | Weld | |
| 2,844,904 | A | 7/1958 | Butler | |
| 3,206,885 | A | 9/1965 | Dye | |
| 3,830,003 | A | 8/1974 | Clerke | |
| 3,849,925 | A | 11/1974 | Mayer | |
| 3,877,167 | A | 4/1975 | Keppeler | |
| 4,312,146 | A | 1/1982 | Koon | |
| 4,385,464 | A | 5/1983 | Casull | |
| 4,890,405 | A | 1/1990 | Krouse | |
| 5,020,260 | A | 6/1991 | Houghton | |
| 5,123,194 | A | 6/1992 | Mason | |
| 5,173,564 | A | 12/1992 | Hammond | |
| 5,247,758 | A | 9/1993 | Mason | |
| 5,487,233 | A | 1/1996 | Jewell | |
| 5,900,577 | A | 5/1999 | Robinson | |
| 6,293,040 | B1 | 9/2001 | Luth | |
| 6,637,142 | B1 | 10/2003 | Reynolds | |
| 6,739,082 | B2 | 5/2004 | Christensen | |
| 6,839,998 | B1 | 1/2005 | Armstrong | |
| 6,886,286 | B2 | 5/2005 | Dowding | |
| 7,086,191 | B2 | 8/2006 | Orr | |
| 7,131,228 | B2 | 11/2006 | Hochstrate | |
| 7,841,119 | B1 * | 11/2010 | Boyd | 42/71.01 |
| 2004/0211104 | A1 | 10/2004 | Eberle | |

* cited by examiner

*Primary Examiner* — Gabriel Klein
(74) *Attorney, Agent, or Firm* — Thompson & Night LLP; James J. Murphy

(57) ABSTRACT

A caliber exchange system for a firearm including a lower plate adapted for embedding within a firearm stock, an upper plate adapted to mate with the lower plate, and a receiver and integral barrel assembly attached to the upper plate to form a caliber exchange unit, the caliber exchange unit attachable and detachable from the lower plate to allow user exchange of caliber of the firearm.

16 Claims, 10 Drawing Sheets

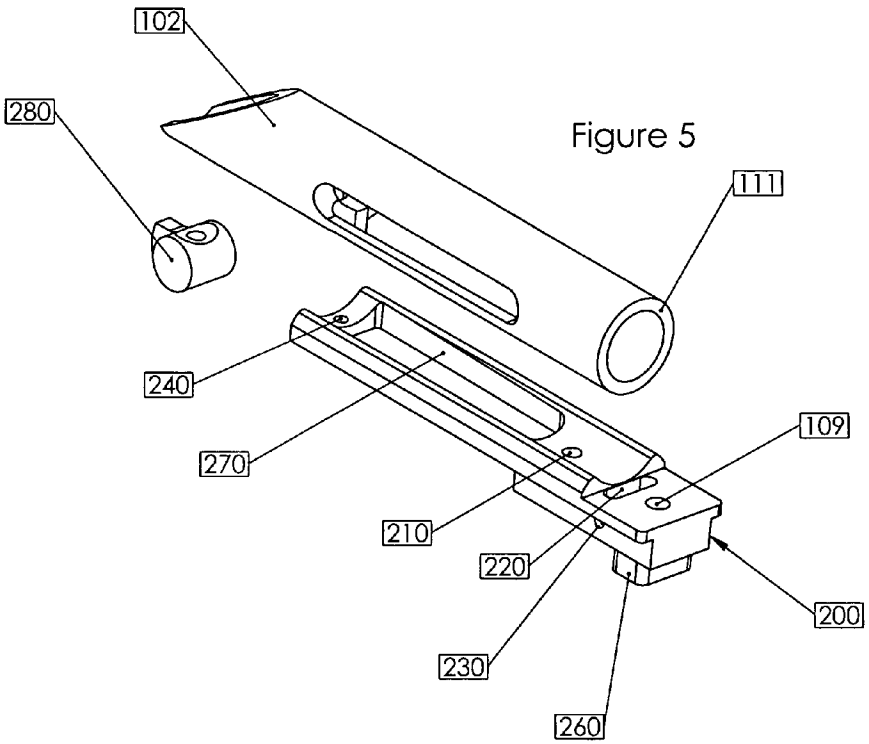
Figure 5
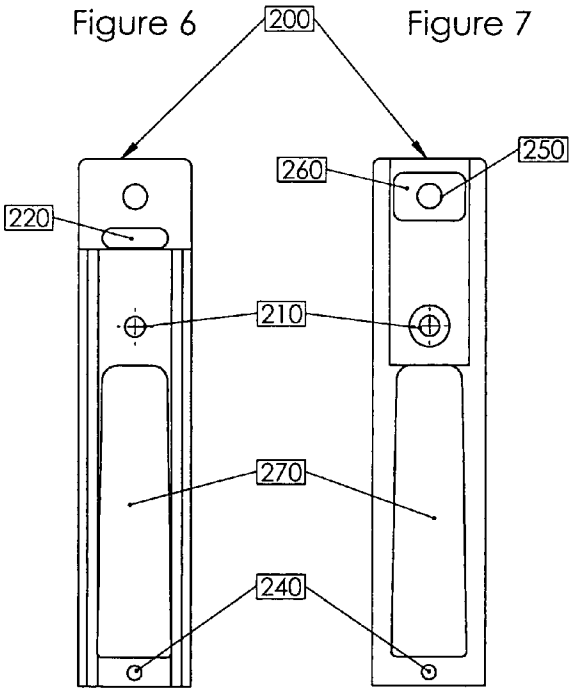
Figure 6
Figure 7
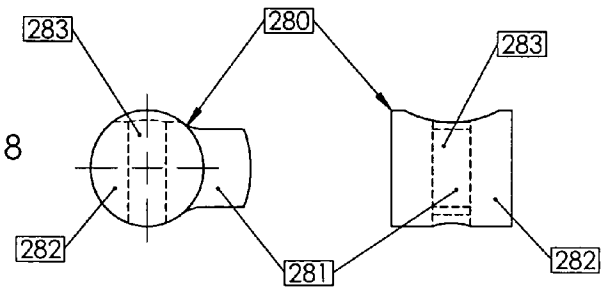
Figure 8

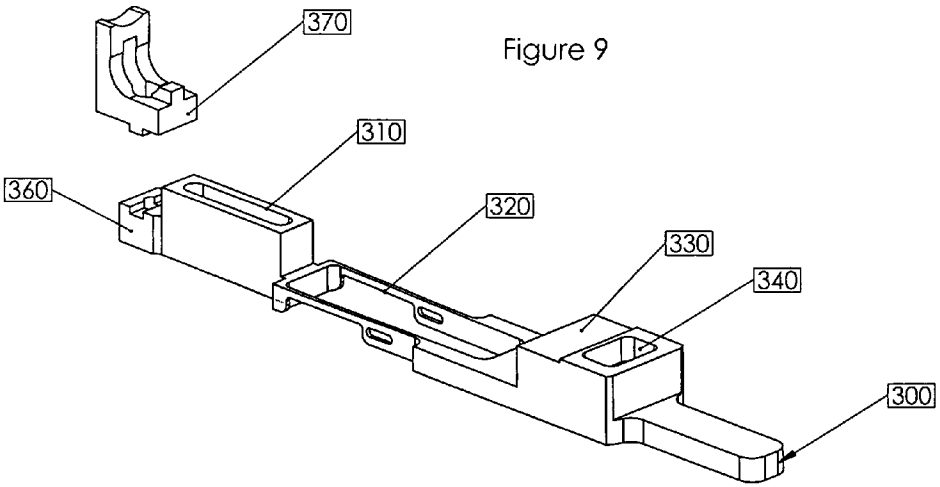
Figure 9
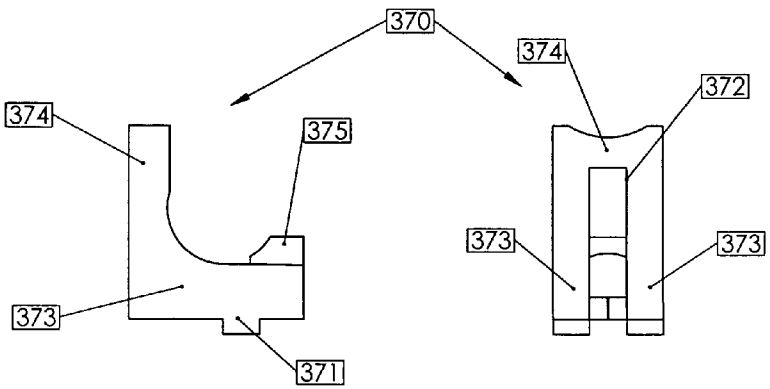
Figure 12
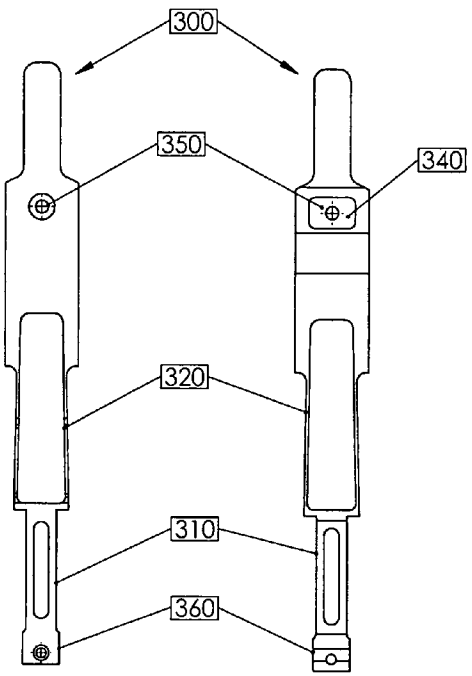
Figure 11
Figure 10

TAKE-DOWN RIFLES INCLUDING A CALIBER EXCHANGE SYSTEM

CROSS REFERENCE TO RELATED APPLICATION

This application claims priority to U.S. patent application Ser. No. 11/981,387, filed Oct. 31, 2007, which is a continuation of U.S. patent application Ser. No. 11/975,420, filed Oct. 19, 2007, which claims the benefit of U.S. Provisional Patent Application No. 60/852,759, filed Oct. 19, 2006.

The following co-pending and co-assigned applications contain related information and are hereby incorporated by reference:

U.S. patent application Ser. No. 11/436,684 to James P. Gregg for Pre-Action Rifle Stock Segmentation System, filed May 18, 2006; and U.S. patent application Ser. No. 11/246,627 to James P. Gregg for Pre-Action Rifle Stock Segmentation System, filed Oct. 7, 2005.

FIELD OF INVENTION

The present invention relates in general to firearms and in particular to take-down rifles including a caliber exchange system.

BACKGROUND OF INVENTION

A factory produced rifle is attached to the factory stock by two anchor points, one through the front of the action that articulates with the front of the trigger guard, and another through the rear of the action that articulates with the rear of the trigger guard. Thus, in a factory rifle, the action is not firmly secured within the stock and will shift with ammunition ignition, a fact which limits the accuracy of the factory produced rifle. Aftermarket improvements implemented by gunsmiths to increase the accuracy of rifles include firmly bedding the barreled action and magazine, floating the barrel, and adjusting of the trigger mechanism. The main components of a firearm are the action, barrel, and trigger mechanism, critical components which allow the firearm to function. A given stock represents simply a method to hold the critical components in a reproducible manner such that predicted results can be repeated. The bedding system allows for the maintenance of accuracy in a firearm and thus creates predictability.

In the traditional configuration of a bolt-action rifle as understood in the prior art, utilizes an arrangement in which the trigger is securely and permanently attached to the receiver. The said permanent attachment insures that the bolt mechanism will engage the trigger mechanism every time the action is operated. This configuration has limited the configurations of previous take-down rifles to two separation mechanisms: one in which the action and barrel are separated and one in which the stock itself is separated in a location behind the action. The unique embodiment of the caliber exchange system is to allow for the trigger mechanism to be separated intentionally from the receiver, an arrangement which allows for a take-down rifle to be created by the separation of the bedding of a rifle. Bedding separation has not been utilized in the prior art due to the limitations that are described below. In short, the bedding systems in the prior art are utilized to create a firm surface for the permanent attachment of a barreled action into the stock. The said attachment is a critical mechanism of creating increased accuracy. Due to the importance of the said bedding system function, the bedding systems were not utilized to create a take-down rifle, as separation of the bedding system would prohibit the accurate utilization of a firearm. Furthermore, concerns of the separation of a trigger mechanism from the receiver include mechanism malfunction. If the trigger is not positioned precisely in the needed orientation, the trigger will fail to accept the bolt mechanism and the rifle will not operate correctly. Thus, if the bedding system is to be utilized for the creation of a take-down rifle, a repeatable and predictable mechanism must be created in order to allow for the trigger to be separated from the receiver.

Beginning with renown benchrest shooters such as Warren Page, the quest for supreme accuracy in a rifle did not become mainstream until the 1960's. Warren Page's book, The Accurate Rifle (copyright 1973, Claymore Publishing Company, Canton, Ohio), was the first classic book discussing the techniques for building an accurate rifle. In the book, Warren Page eloquently places into prose many of the techniques in the art that were previously only discussed by gunsmiths. Warren Page, an avid rifleman, dedicated wildcatter, and exceptional marksman, is credited by many of the people educated in the art of rifles to be the father of modern gunsmithing. The bedding and reloading techniques discussed in the book would form the foundation of modern rifle manufacturing and ammunition reloading. Minimal changes in the methods or process have been made since the original concepts of bedding were introduced.

In the prior art, the term action is understood to represent the mechanism of the firearm that presents a live cartridge into the chamber for firing, and then removes the spent round in order to chamber another live round. The action may include, but is not limited to, a bolt action, a gas operated automatic action, a single action, and a lever action. In general, the term action is also loosely associated with the term "receiver". A receiver is the metallic structure of a firearm that houses the bolt, or the element of a firearm that touches the cartridge and houses the firing mechanism. The terms action and receiver are thus loosely synonymous. A barreled action is a term utilized by those well versed in the prior art to describe the product of mating of a given action with a given barrel. The term is understood widely and will be utilized below in reference to the prior art. The barreled action is then bedded within a given stock.

Bedding systems are utilized in the prior art in order to create a permanent and exact mating surface between the barreled action and the stock. The said permanent surface is created to prevent the movement of a given barreled action within its opposing stock, a function which allows for a uniform bond between the said barreled action and the stock to allow for a consistent relationship to be maintained in the system throughout recoil. The vibrations and relative forces created with recoil are then distributed consistently throughout the system and provide for an increase in accuracy. Thus, in the prior art, a bedding system is understood to describe the direct relationship between a given barred action and its reciprocating stock. The concept is singular in application in that a single bedding system is created to mount a single barreled action of a given caliber to a single stock.

Floating (or free floating) a rifle's barrel is typically performed by isolating the barrel from any contact with the stock forward of the insertion site of the barrel into the action. Generally, barrel floatation is accomplished by channeling the fore-end of the stock so that no portion of the stock is in contact with the barrel. The lack of barrel to stock contact provides increased accuracy by limiting any influences on the position of the barrel. For example, the metal of the barrel expands with the heat produced from repetitive ammunition ignition. Contact between the rifle stock and the barrel may result in pressure points that could cause uneven heating, resulting in uneven expansion and the alteration of a bullets path. Furthermore, vibration is created when a bullet is in contact with the lands of a rifled barrel as it spins down its length and out the end. Floating allows the vibrations to proceed without any external influence on the barrel, a process that increases accuracy by creating the same vibration pattern with every ignition.

Floating is at its best when used with rifles that have relatively large diameter barrels, because they are less flexible than slimmer barrels. Lighter "sporter" barrels are less stable, and may flex enough during the shot that accuracy will suffer. The length of a barrel that is free floating may be variable due to pressure bedding. Remington uses a form of this on their Model 700 rifles—usually leaving a built-up portion of the stock in the barrel channel which applies pressure to the bottom of the barrel at the end of the forearm, but otherwise the barrel is floated.

As stated above, the concept of the bedding of a barreled action is well known in the prior art and represents the creation of a uniform surface in a stock for the mounting of a barreled action. A receiver, or action, has two main ports utilized to secure the said action to the receiver. The two main attachment points are the rear action screw port, located in the receiver directly behind the trigger port, and the front action screw, located on the receiver in front of the magazine port and behind the recoil lug. The recoil lug is an additional structure that is applied at the junction of the receiver and the barrel that serves to prevent shear forces from acting on the action screws with recoil. If one were to remove a barreled action from a stock, one would visualize three main ports in the stock that are designed to fit the rear and front action screws and the recoil lug. These three separate said ports in the stock are the focus of all bedding systems in the prior art.

Bedding consists of creating a stable and consistent contact surface, or mating, between the action (or receiver) and the stock to ensure that there is no movement under the influences of recoil. A thin layer of epoxy material is applied to the stock to provide an exact mating of the barreled action to the stock, a process that allows for tolerances far less than the most exact of machining. With the proper application of epoxy material, the action will have a near zero-tolerance fit to the receiver, a fact which will allow no room for the receiver to move around in from shot to shot. With the proper bedding, the barreled action returns to the exact same place in the stock after ignition, thereby improving the accuracy of the rifle. This process is most often accomplished using compounds designed specifically for this purpose, the compounds usually made of fiberglass resin or other synthetic epoxy.

There are six methods of action and/or barrel bedding in common use today:

1. Full contact bedding of the action with the barrel floated.
2. Full contact-bedding of the action and the barrel.
3. Full contact bedding of the action with a pressure-bearing pad for the barrel.
4. Pillar bedding of the action with the barrel floated.
5. A full length aluminum action bedding block.
6. The action glued to the stock with the barrel floated.

The preferred method depends on the gunsmith's experience and preference, although full contact bedding of the action with the barrel floated, pillar bedding of the action with the barrel floated, and the use of a full length aluminum action bedding block are generally the three most popular methods. Many factory rifles now in production utilize barrel floatation, but production constraints prevent the time required to properly bed the action. While the factory produced rifles have been produced with a general increase in accuracy, there is still room for improvement. The processes of glass bedding and pillar bedding are described for completeness.

The glass bedding technique is utilized to secure the length of the receiver from the rear action screw position to the front action screw position, a process which forms a uniform bed to eliminate any movement within the interface between the receiver and the stock between the said action screw positions. There are two goals to strive for with glass bedding of a rifle: eliminate possible stress to barrel, bolt and action, and to ensure movement relative to its anchor points on stock is minimized during ignition. If the action does not return to the same position on the bedding after ignition, the action cannot be relied upon to shoot with consistent precision or accuracy. Materials needed for action bedding include: bedding compound (Brownells, Acraglas, Acraglas Gel, Glasbed, Steel-Bed, MicroSight's MicroBed, DevCon Plastic Steel, Travaco Marine-Tex), modeling clay, masking tape, three or four 8" elastic bands (for securing receiver while epoxy is curing), release agent (suitable for type of epoxy used), epoxy dyes (to color epoxy to match stock if desired), inlefting tools or Dremel Moto-Tool, coarse, medium and fine sand paper, stock vise or suitable holding fixture, cleaner/degreaser (alcohol, Break Clean, grease-free electrical contact cleaner or trichloroethane), extra long headless action screws, and a disposable container for mixing epoxy.

Reynolds (U.S. Pat. No. 6,637,142 B1) is an intricately described bedding chassis system that improves upon the limitations of the glass bedding process, a bedding configuration in which the entire surface of the receiver and recoil lug are firmly attached to a specially designed stock. In the Reynolds chassis system, a bedding block system is implemented to specifically and permanently bed a single receiver into a single stock with absolute security. The design is implemented to not allow for the receiver to be mobilized within the stock under the recoil forces. Reynolds also utilizes an action mounting insert that is a two part component chassis block system that also permanently beds the full length of the receiver into a stock. The Reynolds bedding block system also utilizes two separate configurations to impart tension on the front edge of the recoil lug.

The inventive principles of the interrupted support surface implemented in the caliber exchange system is an improvement of the Reynolds system in that an increased distance is created in the attachment points between the interrupted support surfaces to allow for a more stable mounting surface for the barreled action, a function which serves to bypass the need for a full length receiver bedding procedure. In addition, the caliber exchange system utilizes a separate series of machined ports with an articulating screw to firmly anchor the recoil lug to the upper support surface, an intended articulated feature that serves to firmly support the receiver/barrel interface.

The purpose of a pillar bedding system is to provide reinforcement for the front and rear action screws. These two screws are the main attachment points of the barreled action and the stock. The pillar system prevents stock compression when the action screws are tightened, a process that removes any stress from the bedding and thus increases the accuracy of the rifle. The pillars are either of generally machined aluminum, titanium, steel, or epoxy with the length depending on the depth of the stock at each of the action bolts. Grooves are machined on the outer circumference to give a good epoxy bond between the stock and the pillars. No direct contact is made between a metal pillar and the action screw. The pillars serve to reinforce the space surrounding the rear and front action screw ports so that the barreled action does not compress the stock when the said front and rear action screws are tightened. The pillar bedding system may be used in addition to the glass bedding procedure. The desired result is again to prevent the motion of a barreled action within a given stock upon recoil. The utilization of the bedding configuration embodied by the caliber exchange system excludes the need for the traditional pillar and glass bedding processes.

Casull (U.S. Pat. No. 4,385,464) describes an example of a bedding system that utilizes a full contact bedding of the action with a pressure-bearing point for the barrel. The bedding system of Casull is described as a rigid insert member that fits snugly within the stock and extends upward beyond the top edge of the housing port by a distance of 2-10 millimeters to provide full length bedding for the action while allowing a partial floatation of the barrel. The traditional locations of the front and rear action screws are utilized to permanently join the action to the stock. The bedding system may be improved upon due to the limited focus of the attachment surface constrained by the traditional location of the said front and rear action screws. The caliber exchange system offers a solution by widening the points of attachment to allow for the floatation of the action and the barrel.

Factory rifles are produced utilizing mass production techniques. Despite the increased tolerances used in the machining of the rifle parts, floatation of the barrel, the bedding of the action, and the adjustment of the trigger mechanism, there is still room for improvement in the accuracy of the factory rifle.

Thus, in the prior art, a bedding surface is merely created in order to facilitate the enhancement of the stability between the connection of the barreled action and the stock. The bedding of a rifle is created as a single one time entity, in which the said surface is created to solidify the relationship between a single barreled action and its associated stock. The bedding systems of the prior art are created to remain in constant contact with the barreled action and are not intentioned to be separated during the utilization of a rifle. No current system exists in which the bedding surface itself is utilized in the creation of a take-down rifle, a rifle in which the action and the barrel are not separated.

The narrow focus of the bedding systems in the prior art is a critical concept inherent in the implementation of the caliber exchange system and is improved upon with the implementation of the interrupted support surfaces. The prior art concentrates the bedding process to the undersurface of the receiver in the portion of the receiver extending between the traditional positions of the rear and front action screw ports, the action screw ports defined as dedicated ports machined in the receiver for the attachment of the said receiver to the stock. In the prior art, the rear and front action screws are the two major attachment points between the receiver and the stock, a given and understood configuration that limits the previous bedding concepts to the said portion of the receiver.

A take-down rifle, defined as a rifle that is transported in two or more parts that are each individually shorter in length than the assembled rifle, in the prior art is created by two main concepts: one, the segmentation of the stock, and two, the separation of the barrel from the action. Each method has disadvantages that are improved on by the caliber exchange system.

The pre-action stock segmentation system in the pre-action location is a method of selectively separating the stock to the rear of the action, creating the maximal portability of a firearm without affecting the inherent relationship between the core components of the rifle, defined as the action, barrel, and trigger mechanism. The pre-action stock segmentation utilizes the rear action screw location as an anchoring point to segment the stock in the weakest and most narrow portion of the stock, a location of the stock that is held by the operator to address the trigger mechanism. The previous limitations of segmenting a stock in this location are overcome by the reinforcement of the said weakest portion of the stock by the insertion of the segmentation device. The limitation of the system is that a single stock containing a single barreled action is segmented, a limitation which limits the usage of the system with a platform that is only capable of utilizing a single given caliber.

Eberle (US 2004/0211104 A1) is a universal modular gunstock consisting of a buttstock, a bedding chassis, and a forestock that is individually capable of mounting a diverse assortment of long gun firearms. The bedding chassis is a full length bedding platform consisting of a single component that is utilized for the bedding of a single action. The bedding chassis is the structural core to which a buttstock and a forestock are attached; a single screw is utilized to attach the buttstock to the chassis in the rear with a dove-tail fit, and multiple screws are utilized to attach the forestock to the chassis in the front with the utilization of sidewall receiving slots. The system may be improved upon as the bedding chassis provides for a full length bedding of a single action, the attachment screw design is cumbersome and would not permit rapid application, and there is no means described to securely attach an action to the bedding chassis. The caliber exchange system utilizes multiple unique features that improve upon the modular gunstock design, provides for a specific means for the selective attachment of an action to a stock, and implements a platform to allow for the floatation of the action.

The current field of firearms has recently addressed multiple improvements for the "black rifle", or the semi-automatic gas operated combat rifle, currently utilized by the United States armed forces in the M-16 configuration, and the civilian models AR-15 and AR-10. The said configuration of the semi-automatic prior art rifle weapon is understood by and utilized in the improvements set forth by Luth (U.S. Pat. No. 6,293,040 B1), Hochstrate (U.S. Pat. No. 7,131,228 B2), Armstrong (U.S. Pat. No. 6,839,998), Hammond (U.S. Pat. No. 5,173,564), Christensen (U.S. Pat. No. 6,739,082 B2), Robinson (U.S. Pat. No. 5,900,577), Keppeler (U.S. Pat. No. 3,877,167), and Mayer (U.S. Pat. No. 3,849,925). The configuration is well known in the art and is described by Luth (U.S. Pat. No. 6,293,040 B1). The upper receiver assembly of the prior art consists of an upper receiver and barrel assembly, with a barrel nut utilized at the interface between the upper receiver and the barrel. The recoil lug as understood in the prior art for other rifle configurations is not utilized in the said semi-automatic gas operated rifle. The upper receiver is attached to the lower receiver by two attachment points, the forward locking lug and the rear locking lug, both attachment points are utilized on the receiver side of the barrel and are integral components machined into the said upper receiver assembly.

The trigger mechanism is assembled within the lower receiver assembly in following with the prior art rifle configuration of the semi-automatic weapon. The trigger mechanism of a "black rifle" is distinctly different in configuration from that of a bolt action rifle. As described by Luth, the trigger mechanism, sear, and hammer assembly are positioned within the lower receiver assembly. The firing pin and mechanism are housed separately in the upper receiver assembly. The hammer in the lower assembly, when released by the trigger, strikes an inertia firing pin in the bolt of the upper assembly. The firing pin accelerates towards the cartridge primer and after ignition returns to its original position by means of a spring. The action of the spring is powered by gas funneled in from the barrel. After firing, the bolt is forced back, cocks the hammer and the cycle is repeated. The firing pin spring returns the bolt to its original position to be ready to be struck by the hammer and fired again. The firing pin and mechanism are housed in the upper receiver, and the hammer and trigger mechanism remains attached to the lower end of the rifle when the upper part is removed during disassembly.

In a conventional bolt action rifle, the spring is contained within the bolt itself, and thus is not positioned within the stock, as described above in the said black rifle configuration known in the prior art. Thus, in a bolt action rifle trigger mechanism, the functionality of the spring is within the actual receiver, or bolt more specifically, and a hammer is not utilized. The trigger mechanism in a bolt action rifle is always attached to the receiver and catches the cocking mechanism when a round is placed into the chamber during the cycling of the bolt. Thus, the trigger serves only to catch and release the firing pin in a bolt action rifle. Furthermore, firing pins have their springs on the opposite side of that found on assault rifles, and the said bolt action spring itself is used to accelerate the pin towards the primer. The importance of the position of a trigger mechanism in a bolt action rifle is crucial, as the mechanism must be positioned in a configuration in which the trigger mechanism may catch the bolt on every pass to allow for proper function. For this reason, the trigger is always positioned attached to the receiver in a bolt action rifle. The trigger configuration of the caliber exchange system utilizes an interrupted bedding surface to house the trigger separately from the receiver.

An interchangeable weapon receiver for alternate ammunition of Luth (U.S. Pat. No. 6,293,040 B1) improves upon the semi-automatic prior art rifle weapon noted to be the M-16/AR-15 rifle with a lower receiver assembly and an upper receiver assembly, a prior art configuration as understood and improved on by the said above patents. The interchangeable upper receiver assembly of Luth (U.S. Pat. No. 6,293,040 B1), as described by Luth, is designed to be utilized with the lower receiver assembly of the exemplary prior art weapon in order to incorporate the functionality of multiple types of projectiles. In the described inventive principles put forth by Luth, the semi-automatic gas operated upper receiver of the prior art rifle is exchanged for an interchangeable single shot upper receiver. The interchangeable upper receiver is described as a smooth bore single shot weapon that is to be manually loaded at the breech, a mechanism that does not utilize the previously described gas operation for semi-automatic use. Thus, in Luth, a repeater rifle is converted into a single shot weapon. The breech loading functionality of the said interchangeable upper receiver assembly is depicted in the figures as a mechanism in which the said barrel is separated from the said receiver and the cartridge is loaded at the breech, or the described integral, unitary breech block. The single-shot breech loading mechanism is utilized to fire single rounds of shotgun, flare, and grenade cartridges from a semi-automatic rifle, a function which allows a soldier to limit the number of weapons that must be carried into an engagement. The said multiple cartridges are fired from a consistently carried unitary breech block, a configuration analogous to the barrel switch configuration of bolt action rifles.

The bolt action, in a repeater or single shot configuration, is well understood in the art to represent a separate functionality from the said single shot breech loading and semi-automatic gas operated configurations. The caliber exchange system improves upon the limitations of the said interchangeable weapon receiver system by creating a stable precise bedding system in which a unique interrupted bedding surface utilizing attachment point separation is created in a stock to allow for multiple rounds to be fired from a single given receiver-barrel combination. In the caliber exchange system, the unique bedding system allows for the precision usage of multiple rimfire and centerfire calibers from a single bolt action platform that provides for the precise shot placement at ranges exceeding 1000 meters, an effective distance dependent on the caliber utilized.

An additional configuration is utilized in a typical gas-operated semi-automatic rifle (U.S. Pat. No. 5,247,758) in which a rigid truss is utilized within a stock to directly attach a barrel and stock, a structure that houses the gas operated slide mechanism. The caliber exchange system improves upon this configuration by supporting the barreled action on the barrel side of the receiver/barrel interface without directly contacting the barrel.

A further configuration utilized in a typical semi-automatic blowback rifle where the receiver is mounted in the buttstock in a bullpup configuration (U.S. Pat. No. 4,890,405) provides for an attachment forward of the receiver in which the said mounting configuration allows for rotational and horizontal movement of the receiver and barrel after firing.

In the prior art, the most portable systems utilized in the creation of a take-down rifle are the systems that implement a separation of the action from the barrel. Many such configurations exist, but principle implemented is consistent. The separation of the barrel from the action allows for the creation of a take-down rifle into two separate portions that are roughly equal in length. The said separation has limitations as the said separation allows for increased wear of the mobilized parts and requires the system to be re-sighted after the re-articulation of the parts if the barrel applied is of a separate caliber. Separation of the action from the barrel may be represented by firearms manufactured by HS Precision, Dakota, Merkel, Blaser, Harrington and Richards, and Thompson. The separation of the action and barrel, in addition to the barrel switch configuration, is limited due to the mechanics of the said separation. An additional limitation is the high cost of production due to the necessity of providing multiple bolt faces necessary for the proper implementation of some of the barrel switch configurations. The caliber exchange system offers an improvement over such limitations by creating a platform for exchange in which the action and barrel remain united throughout the operation of the platform, a said platform in which the interface between the action and the barrel are maintained in the creation of a take-down rifle.

The take-down rifle with the caliber exchanging system is desired for three specific populations: one, a civilian or solder who wants a compact rifle for inclusion into survival packs; two, the hunter that will be traveling to remote regions who needs a rifle that will fit into compact space and be easily portable; and three, military snipers who will need to conceal the rifle will engaging in counter-terrorism actions, a situation in which the rifle may have to be concealed from surrounding civilian observation. In all instances, the accuracy of the rifle is paramount and no doubt as to point of impact changes should have to be considered. The market may also be separated into two groups based on two cartridge configurations: rimfire and centerfire cartridges. Each population may additionally benefit from the use of a single platform that is capable of utilizing multiple calibers without any change in accuracy incurred during the usage of the said caliber exchange.

The term receiver/barrel combination is utilized in the present invention in order to differentiate the functionality of a barreled action in the prior art from the functionality of the said combination between receiver and barrel in the present invention. A receiver/barrel combination is an entity referring to a given unit consisting of a receiver and a barrel of a given caliber. The receiver/barrel combination, when combined to one of the interrupted support surfaces, forms a singular unit, selectively separated from a stock and its corresponding interrupted support surfaces. Thus, the term receiver/barrel combination is utilized to note the independent function of the said combination from that of the stock. The inventive principles of the caliber exchange system allow for multiple independent receiver/barrel combinations to be utilized from a single stock platform.

The removal of a receiver/barrel combination from the stock allows for a system to be created in which the entire undersurface of the receiver/barrel combination is utilized, a surface that extends from the rear action screw position behind the trigger port in the receiver to the region on the barrel side of the recoil lug. The said surfaces to be utilized are understood upon the complete removal of a receiver/barrel combination from the stock. The Custom High Country Take-Down Rifle discussed below is used to illustrate how the prior art conceptualizes the separation of the barreled action from the stock, and the limitations inherent in the principles of the traditional mating of a single barreled action with a single stock.

The Custom High Country Take-Down Rifle manufactured by Brown Precision, Inc is the closest concept to the caliber exchanging system that exists in the prior art. The High Country rifle is a take-down rifle produced from the separation of the barreled action from the stock by the utilization of the rear and forward action screws. In the High Country rifle, the rear and forward action screw ports are utilized to form the separation of the unsupported barreled action from the stock, the said configuration produces a take-down rifle from the disengagement of the said front and rear action screw ports. The said separated barreled action component includes the receiver, action, barrel, and trigger mechanism; a component that does not include a separate bedding surface. In order to utilize the High Country rifle, the operator must simply disengage the front and rear action screws, and the barreled action is separated from the stock. The recoil lug is consistent with the prior art, and does not include any attachment port, a configuration in which the inferior extension of the recoil lug is to merely be accepted by the bedding surface within the given stock. Thus, the recoil lug is not utilized in a function outside of the current prior art. The stock component of the High Country rifle contains the entire bedding surface of the rifle system; importantly, the inherent barreled action itself is to act as the likeness of a superior bedding surface in that the said barreled action itself is the only surface utilized, and a separate bedding surface is not applied to the said rifle component itself. As noted, the bedding surface itself, in any given configuration included in the said High Country rifle, is located completely within the said stock of the High Country Rifle. In such a configuration, the rifle does not utilize the bedding surface in any configuration outside of the current prior art. Most importantly the said Custom High Country Take-Down Rifle is implemented as a system for the exact purpose as the name implies, a take-down rifle. Thus, the said separation of the barreled action from the stock in the High Country rifle is implemented only as a means of producing a take-down rifle. The said High Country Rifle is manufactured with an intent only to be a take-down rifle, and the said configuration is not intended to be used as a caliber exchanging system.

The Custom High Country Take-Down Rifle manufactured by Brown Precision, Inc is a rifle manufactured with the explicit purpose of providing a customer with a take-down rifle. The High Country rifle is not manufactured with the explicit purpose to be used as a caliber exchanging system. Further, there is not any expression within the literature for the utilization of the High Country rifle as an embodiment that would include the intent of creating a product that would include the inventive principles of a caliber exchanging system; the said literature defined as the information presented to an interested customer for the purpose of individual purchase and usage, the said information presented to a possible company for the manufacturing of a take-down rifle, and the said literature including all written materials provided on the internet for a reasonable search of the mechanism of product type or intentions of the usage of a given product type. In the provided said literature concerning the said Custom High Country Take-Down rifle, the said company describes the said rifle in the following manner: "This Custom High Country Take-Down rifle has been designed for the traveling hunter looking for a full-sized rifle in a compact package, with repeatability and accuracy Brown Precision is famous for". Inherent in the given description of the said High Country Rifle provided in the disclosure of the product by the said Brown Precision, Inc to a customer or manufacturer, or one of the said parties researching the utilization of the product for a possible patent search, is that fact that the said High Country rifle is sold with the explicit purpose of providing the customer with a take-down rifle. The said rifle is not intended to provide a given customer with the option of utilizing multiple calibers from a single given platform, the platform being a take-down rifle utilizing the embodiments of a caliber exchanging system. Thus, the Custom High Country Take-down rifle is only sold with the intent of embodying a take-down rifle.

Further, the said High Country Rifle does not include any embodiment outside of the prior art, in that the segmentation of the barreled action from the stock may be utilized with any given rifle, as the separation of the said rifle is only a disengagement of the front and rear action screws. One who is intent on creating a take-down rifle that utilizes the configuration inherent in the embodiment of the said High Country rifle may only have to take any given factory produced rifle, remove the said rear and forward action screws, and the embodiment of the said High Country Take-down rifle is created. Thus, there is no new addition to the prior art in the utilization of the embodiment of the said High Country Take-down rifle.

The High Country Take-down rifle is not an infringement of the inventive principles of the caliber exchanging system for the following reasons: the said rifle is produced for the explicit of producing a given rifle for the purpose of utilizing the said rifle as a take-down rifle, the said rifle produces the said take-down conversion from the simple disengagement of the said front and rear action screws, the said rifle is not to be implemented as a platform that provides the utilization of multiple calibers, the said rifle does not include any bedding surface constructed for the explicit purpose of providing a given bedding surface in the said segmented barreled action component, the said rifle does not utilize a detachable magazine, the said rifle includes a stock which contains the entire bedding surface that is to be utilized by the said rifle in the implementation of the take-down rifle, and the said rifle does not include the segmentation of any portion of the said stock of the said take-down rifle, a fact which implies that the stock is a uniform single component and is not to be utilized in the segmentation process that defines the said take-down rifle. Most importantly, the embodiment of the take-down rifle as defined in the literature concerning the said High Country Take-down rifle, does not differ from the inventive principles included in the prior art, as the creation of the take-down rifle in the embodiment of the said High Country Take-down rifle utilizes only the disengagement of the said front and rear action screw ports, a function which may be utilized in any given rifle within the current art.

The caliber exchanging system differs from the embodiment of the High Country Take-down rifle in many ways. The caliber exchanging system, as disclosed in the described inventive principles of the said caliber exchanging system, creates a take-down rifle in which the bedding surface of a given rifle is separated to create the said take-down function, and the utilization of the said segmentation of the bedding surfaces functions as an inventive method to allow the utilization of multiple calibers from a single platform. In the inventive principles of the caliber exchanging system, the receiver/barrel combination is supported by an upper retention housing, a purpose which provides a partial bedding surface for the said receiver/barrel combination. The utilization of a partial bedding surface allows the receiver/barrel combination to be bedded to a separate component, individual of the bedding within a given stock, so that accuracy may be further maintained during the implementation of the said caliber exchanging system. The caliber exchange system utilizes a unique principle of attachment point separation that allows for the creation of a platform in which the increased stability provided by the said attachment point separation to allow for the floatation of the receiver/barrel combination. In one embodiment, the receiver/barrel combination utilizes a pillar-bushing configuration to provide the attachment points. In a further embodiment, the caliber exchange system utilizes two separate attachment point mechanisms: one a screw-less joint, and the other a single screw. The inventive principles of the attachment point mechanisms create a highly precise, elegant manner for securing a receiver/barrel combination to an interrupted bedding surface. Further, the recoil lug, as described in the inventive principles of the caliber exchanging system, utilizes an articulation port for the bedding of the receiver/barrel combination within the interrupted bedding surface.

The inventive principles of the caliber exchange system improve upon the limitations of the current concepts applied to the bedding of a barreled action into a stock. Such current bedding concepts are limited in focus as the prior art illustrates a myriad of bedding methods which utilize the traditional configuration of the front and rear action screw locations to bed the barreled action. Further, most systems utilize a full length bedding of the action to inhibit motion of the action within the stock. The narrow focus of the bedding systems of the prior art is the focus of the attention on the locations of the rear and front action screws.

The limited focus of the current utilization of bedding processes must be emphasized. The traditional configuration of a single receiver/barrel combination to a single dedicated stock has created a focus in the prior art to the said region on the receiver between the rear and front action screw ports and the recoil lug. Thus, if the traditional bedding techniques focus on bedding a single receiver/barrel combination into a single stock utilizing the rear and front action screw ports, the said focus is then understood to be the length of the receiver and the recoil lug. In the traditional configuration, the receiver/barrel combination is viewed as a single entity that is to be permanently attached to a stock. Due to the fact that the rear and front action screws are positioned in a standard configuration, a configuration in which the rear action screw port is positioned behind the trigger and the front action screw is positioned in front of the magazine but rear to the recoil lug, the distance between the rear and front action screw positions is relatively fixed. When a gunsmith, well versed in the prior art, is requested to "bed" a receiver, the gunsmith will focus on the said rear and front action screws and the recoil lug. Thus, the bedding process known in the prior art will focus on the region of the receiver in between the rear and front action screws and the recoil lug, and will use one or more of the above said processes for the bedding of the said receiver.

The limited focus of the prior art is emphasized when a receiver/combination is designed to be selectively separated from a given stock, a process that is utilized in the creation of a takedown rifle in the present invention. When the receiver/barrel combination is to be separated from a given stock by direct intent, the focus on the region of the receiver/barrel combination to the rear of the recoil lug is then viewed as a limited surface. In following, when a receiver/barrel combination is to be intently separated from a given stock, the entire surface of the said receiver/barrel combination may then be utilized in a bedding process. Specifically, the region on the barrel side of the receiver/barrel interface may then be used to attach the said receiver/barrel combination to a stock. Thus, the understood relationship between the receiver/barrel combination and the stock is extended in breadth when the said receiver/barrel combination is removed by direct intent from the stock.

When a receiver/barrel combination is intently removed from a given stock, the region of the said combination on the barrel side of the receiver/barrel interface may then be utilized for the attachment of the said receiver/barrel combination to a given stock. Due to this unique relationship, the traditional distance between the rear and front action screws may be increased. The receiver/barrel combination may then be attached to a given stock via two attachment sites: the rear action screw port, positioned to the rear of the trigger port of the receiver, and a forward attachment point on the barrel side of the receiver/barrel interface. The increased distance created by this unique relationship allow for a more stable platform to be created when attaching a receiver/barrel combination to a given stock. The increased stability of the relationship allows for the traditional bedding processes to be bypassed, a configuration which will also allow for the complete floating of the receiver/barrel combination within the stock.

The concept unique to the caliber exchange system is the creation of a more stable platform for the mounting of a receiver/barrel combination by increasing the distance between the two said traditional primary attachment points. Thus, a receiver/barrel combination is mounted with greater stability to a given stock by the creation of the increased distance between the two attachment points. By increasing the distance between the attachment points, the focus on the center of the receiver, the region of the interface focused on with the current concepts of "bedding", is by-passed, and the current bedding processes understood within the prior art may be omitted in the application of a receiver/barrel combination to a given stock.

An understanding of the creation of an attachment point on the barrel side of the receiver/barrel interface to attach a receiver/barrel combination to a given stock is crucial to the inventive principles of the caliber exchange system. The relationship between the front and rear action screw positions, and the stability that the traditional configuration provides, may be illustrated by the holding of a pencil. The traditional distance between the front and rear action screw positions is illustrated by holding a pencil in the middle of the length of the instrument between the thumb and index finger of each hand with the thumb and index finger of the left hand positioned immediately adjacent to the thumb and index finger of the right hand, both in a position at the center of the pencil. The placement of the hands in the center of the pencil illustrates the usage of traditional bedding configurations, in which the center portion of the receiver is firmly bedded to the stock. The traditional configuration (the said position of the hands) allows for increased mobility of the pencil while secured by the hands. The inventive principles of the caliber exchange system allow for an increase in the distance between the fingers of the right and left hand, respectively. To continue to analogy, in the caliber exchange system, the fingers of the right hand will hold the pencil at one end, and the fingers of the left hand will hold the pencil at the opposite end. By increasing the distance between the hands, the writing instrument is better supported. Further, the stabilizing of the pencil on either end allows for the center portion of the pencil to remain unsupported. Thus, the stabilization of the pencil is illustrated by securing the writing instrument over a longer distance, the increased distance created by the unique position of the attachment surfaces, a relationship which allows for the center portion of a body to be stabilized to remain unsupported.

In summary, the inventive principles of the caliber exchange system improve upon the limitations of all of the previous bedding systems and the limitations described in the manufacturing of a take-down rifle.

SUMMARY OF THE INVENTION

The inventive principles of the caliber exchange system overcome the limitations of current bedding techniques to create a stable and precise selective mating configuration between a given receiver/barrel combination and a separate uniform platform. The selective separation of a receiver/barrel combination from the platform allow for the inventive principles of the caliber exchange system to function as a take-down rifle, a configuration in which the two said selectively separated bodies may be transported with increased portability. With the consistency created from the precision of the attachment surfaces and the elegant operation of the selective separation, the single platform may be utilized to service multiple receiver/barrel combinations of a plurality of calibers. The caliber exchange system utilizes a single attachment screw that must be independently operated to implement the said selective attachment, a configuration which is an improvement on some of the cumbersome attempts in the prior art. The ease of operation and implementation of the caliber exchange system provides for rapid, reliable, and repeatable deployment in the field under any conditions. Conservation of the physical construct of the receiver, barrel, and sighting mechanism throughout the utilization of the caliber exchange and take-down rifle functions allows for the platform to maintain accuracy and avoid point of impact changes during the selective removal and application of a plurality of receiver/barrel combination caliber groups. The implementation of the inventive principles of the caliber exchange system in the creation a take-down rifle by utilizing the bedding system as the segmentation location is unique and prevents separation of the critical components of the rifle, a configuration which is an improvement over the take-down systems in which the receiver and barrel are separated or the barrel is switched.

The bedding systems in the prior art are narrowed in focus due to the acceptance of the constraints inherent in a given receiver, with respect to available ports for attachment, and acceptance of the constraints of a stock visualized as a single structure containing attachment points that mirror a given receiver used peculiarly to firmly secure the said receiver to a given mating stock. The vast majority of bedding configurations in the prior art utilize, in variable contributions, the rear action screw, the front action screw, and the recoil lug, in the creation of a full length bedding of the receiver. The focus of the current bedding systems is narrowed due to the persistent dependence of the said attachment points on the receiver and the opposing mirrored surfaces on the stock. The concept is further narrowed by the concept that a single stock should be only utilized by a single receiver/barrel combination.

The direct, intended removal of the receiver/barrel combination from the stock expands upon the limitations of the current bedding techniques by allowing for the entire undersurface of the said receiver/barrel combination to be utilized as a bedding surface. By physically extending the surface underneath the receiver anteriorly to a point located on the barrel side of the recoil lug axis, the bedding surface available for usage is increased. The positioning of a separate, mechanical forward attachment point on the barrel side of the receiver/barrel interface allows for an increased distance to be created between the attachment points utilized in the mating of a given receiver/barrel combination to a stock. The attachment point separation, or the said increased distance created by the utilization of an independent screw point on the barrel side of the receiver/barrel interface, is operable to form a more stable platform for the mounting of a receiver/barrel combination to a given stock, an arrangement which allows for the floatation of the remaining free portions of the said receiver/barrel combination, a function which improves upon a prior limitation realized in all bedding practices understood in the prior art.

The caliber exchange system utilizes the inventive principles of an interrupted retention housing and a specific attachment point configuration to allow for the selective separation of a receiver/barrel combination of a given caliber from a given stock. Selective attachment/separation is defined as the intended separation of the receiver/barrel combination from the stock and then the replacement of the said receiver/barrel combination depending on the demands of the operator, a relationship that requires independent operation by a user in order to purposefully separate the firearm platform into two major components for the creation of a take-down rifle. Replacement of a given receiver/barrel combination of a given caliber for an additional independent receiver/barrel combination of an additional independent given caliber allows for the implementation of the inventive principles of the present invention in the caliber exchange function.

The implementation of the unique interrupted support surface allows for a given receiver/barrel combination to be mated to a stock with a high degree of precision, such tolerances allow for a consistent surface to be created between a plurality of receiver/barrel combinations with a single platform. The interrupted configuration, in which an upper moiety is utilized to stabilize the receiver/barrel interface and provide for the means of attachment point separation and a lower moiety is utilized as a solid, stable platform within the stock, allows for the implementation of the caliber exchange and take-down rifle functions.

Three separate permanent articulation points between the upper retention housing and the receiver/barrel combination firmly bond the two said components, a bond which stabilizes the receiver/barrel interface by increasing the stiffness of the system at the said junction of the receiver and barrel. With the inventive principles of a separate articulation screw port and independent screw, a unique recoil lug is utilized in the stabilization of the receiver/barrel interface, a function separate of the understood recoil lug functionality as held within the prior art. The upper retention housing positions a separate articulating port on the barrel side of the receiver/barrel interface for utilization in the mating between the interrupted retention housings.

The lower retention housing allows for a stable platform to be created for the application of a plurality of receiver/barrel combinations. The uniform base, with attachment points at either end, creates a precise and repeatable surface for the consistent presentation of the trigger mechanism into the receiver, a configuration which overcomes previous limitations of the positioning of the trigger mechanism. The uniform base also overcomes the limitations of previous bedding systems in which the material utilized in the construction of the stock affects the receiver/stock relationship. In the embodiment of the caliber exchange system, the stock material chosen by the operator does not affect the inherent function of the system, as the attachment points are upper housing to lower housing, without the involvement of the stock material itself.

Bonding of components to the major surfaces may utilize any of the liquid epoxy materials inherent in the usage of current bedding techniques. The multiple permanent attachment points secured with a separate articulating screw may be strengthened from the application of anaerobic glue or loctite. The said permanent attachment points may be mobilized for the maintenance or replacement of any of the system components, including but not limited to the receiver/barrel combination, upper retention housing, articulation screws, the front and rear attachment elements, and the lower retention housing.

The inventive principles of the caliber exchange system include the configurations and locations of the attachment points between the upper and lower retention surfaces. The unique embodiment of attachment point separation allows for the floatation of the entire receiver/barrel combination and the utilization of two exact points for the selective attachment between the receiver/barrel combination and the stock. The embodiments of the attachment point elements are central to the implementation of the caliber exchange system, as the mating must be precise to allow for predictable and repeatable results. One embodiment utilizes a tail-hook configuration in the rear and a single screw attachment in the front to perform the said selective attachment function. Another embodiment utilizes a pillar-bushing system to anchor the attachment points between the upper and lower retention housing surfaces.

The caliber exchange system allows for a given receiver/barrel combination of a given caliber to be selectively replaced by an additional receiver/barrel combination of a different given caliber. Selective separation of the interrupted support surface is to allow for the platform to be selectively separated at the interface between the support surfaces, a relationship which allows for increased portability of the two active portions, and thus serving the function of a take-down rifle. The support surfaces are selectively separated in an exact configuration to allow for the critical components of the rifle, defined as the receiver, barrel, and sighting mechanism, to remain permanently joined throughout the operation of the caliber exchange system. Lastly, the mechanisms embodied by the attachment points in the present invention allow for an elegant attachment configuration that is streamlined to be operable by the external manipulation of a single screw.

The unique embodiments of the attachment point separation, the interrupted support surface, attachment point mechanism are fundamental in the implementation of the caliber exchange system and allow for the operation of the caliber exchange and take-down rifle functions.

BRIEF DESCRIPTION OF DRAWINGS

For a more complete understanding of the present invention, and the advantages thereof, reference is now made to the following descriptions taken in conjunction with the accompanying drawings, in which:

FIG. 5 is a diagram of the upper retention housing of the caliber exchange system.

FIG. 6 is a diagram of the top view of the upper retention housing.

FIG. 7 is a diagram of the bottom view of the upper retention housing.

FIG. 8 is a diagram of the side and front views of the tail-hook top component.

FIG. 9 is a diagram of the lower retention housing and the tail-hook bottom components.

FIG. 10 is a diagram of the bottom view of the lower retention housing.

FIG. 11 is a diagram of the top view of the lower retention housing.

FIG. 12 is a diagram of the side and front views of the tail-hook bottom component.

DETAILED DESCRIPTION OF THE INVENTION

Figure 1:
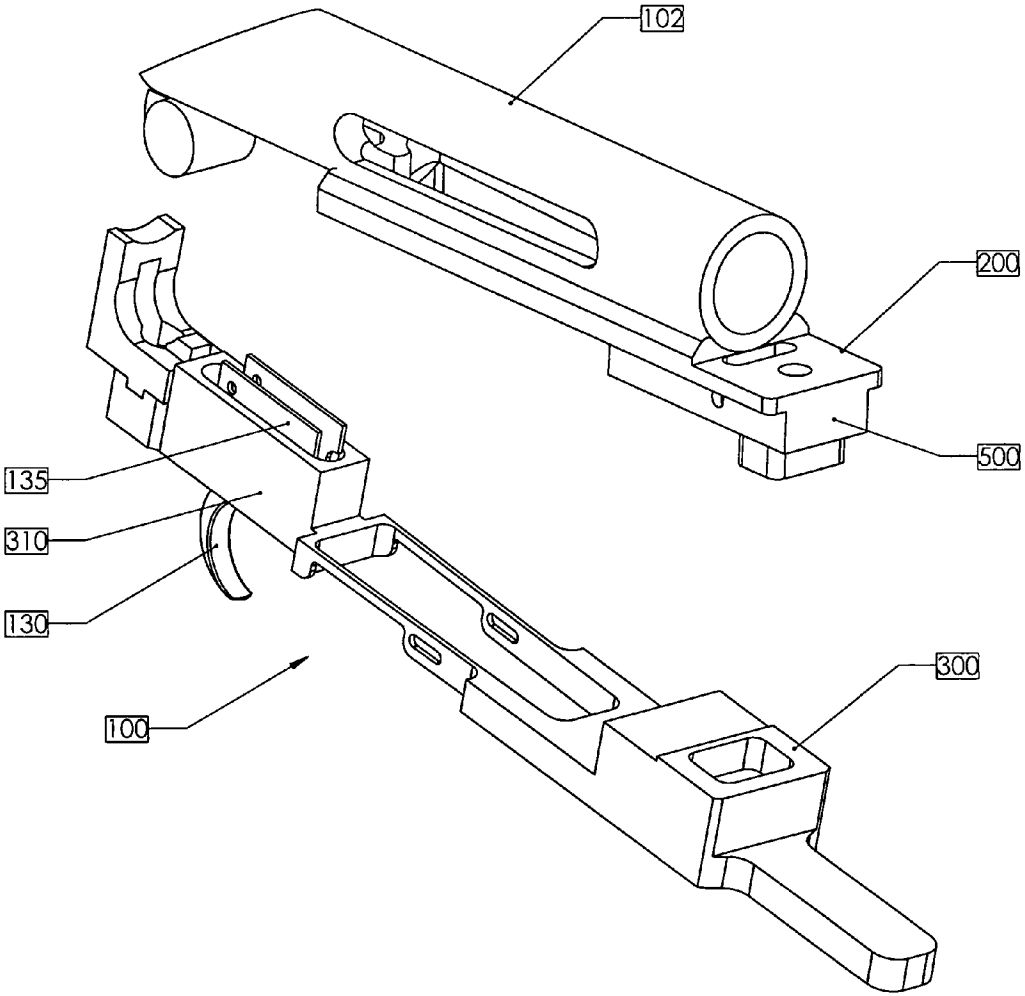
FIG. 1 is a diagram of the caliber exchange system.

The principles of the present invention and their advantages are best understood by referring to the illustrated embodiment depicted in FIGS. 1-18 of the drawings, in which like numbers designate like parts.

General Concept

In the traditional configuration of a bolt-action rifle as understood in the prior art, the bolt-action rifle utilizes an arrangement in which the trigger is securely and permanently attached to the receiver. The said permanent attachment of the receiver to the trigger insures that the bolt mechanism will engage the trigger mechanism every time the action is operated. This configuration has limited the configurations of previous take-down rifles to two separation mechanisms: one in which the action and barrel are separated and one in which the stock itself is separated in a location behind the action. The unique embodiment of the caliber exchange system is to allow for the trigger mechanism to be separated intentionally from the receiver, an arrangement which allows for a take-down rifle to be created by the separation of the bedding of a rifle. Bedding separation has not been utilized in the prior art due to the limitations that are described below.

In short, the bedding systems in the prior art are utilized to create a firm surface for the permanent attachment of a barreled action into the stock. The said attachment is a critical mechanism of creating increased accuracy. Due to the importance of the said bedding system function, the bedding systems were not utilized to create a take-down rifle, as separation of the bedding system would prohibit the accurate utilization of a firearm. Furthermore, concerns of the separation of a trigger mechanism from the receiver include mechanism malfunction. If the trigger is not positioned precisely in the needed orientation, the trigger will fail to accept the bolt mechanism and the rifle will not operate correctly.

An important embodiment of the invention is to allow for the trigger to be housed in the stock and selectively separated from the receiver, a configuration which is unique. The invention allows for the stable and permanent mounting of a trigger mechanism within the lower component of the interrupted bedding system. The utilization of attachment point separation allows for a very precise mounting surface to be created between the receiver and the trigger mechanism, an arrangement which is utilized to produce a take-down rifle by the separation of the bedding system.

Caliber Exchanging System: General Concept

The caliber exchanging system utilizes attachment point separation, an interrupted bedding system, and a specific attachment point configuration to allow for the selective removal of a given receiver/barrel combination of a given caliber from a stock, and to selectively replace the said given receiver/barrel combination by an additional receiver/barrel combination of a different caliber. The said selective removal of the receiver/barrel combination may additionally be utilized as a take-down rifle. The unique embodiments of the caliber exchange system allow for the caliber exchange and take-down rifle functions to be utilized without the separation of the core components of the rifle, a fact which insures the maintenance of the accuracy of the platform throughout operation of the inventive principles. The full description and disclosure of the invention of the caliber exchange system is defined in the inventive principles described below.

General Concept

The principles of the present invention are generally embodied in a take-down rifle, including but not limited to the caliber exchange system 100 shown in (FIG. 1), based on an assembly of an upper and lower retention housings and rear attachment elements. The elements of the present invention are positioned to create a unique platform that facilitates the selective separation of a given receiver/barrel combination from a stock, a function that permits the utilization of the inventive principles of the caliber exchange in the formation of a take-down rifle. The increased stability of the platform created by the attachment point separation allows for a consistent relationship to be maintained between the critical components of the rifle, defined as the receiver, the barrel, and the sighting mechanism. The precise mating system allows for uniformity of operation between each selective separation, a level of precision that allows for the use of multiple receiver/barrel groups of a plurality of calibers. As depicted in FIG. 1, the caliber exchange system 100 consists of three major components: the upper retention housing 200, a component that is operable to be permanently attached to a receiver 102; the lower retention housing 300, operable to be permanently attached to a given stock 101 (FIG. 2); and the rear 400 and forward 500 attachment elements, elements operable to form two separate widely spaced attachment points for the selective attachment of a given receiver/barrel combination to a stock. Selective attachment is defined as the intended separation and articulation of the receiver/barrel combination from the stock, a relationship that requires independent operation by a user in order to purposefully separate the firearm platform into two major components for the creation of a take-down rifle. The two major components that are created are the receiver/barrel combination 104, permanently attached to an upper retention housing 200, and a given stock 101, permanently attached to a lower retention housing 300.

Rifle Stock Defined

Figure 3:
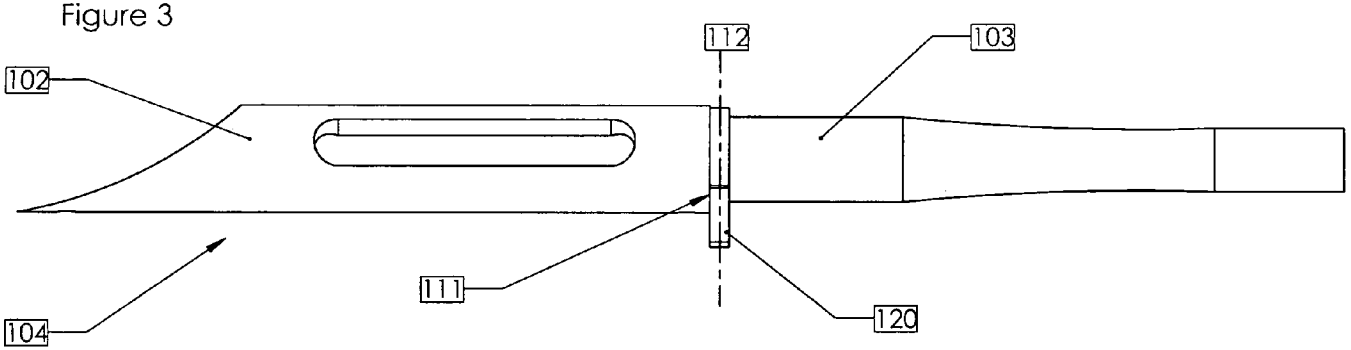
FIG. 3 is a diagram of the receiver, barrel, and recoil lug of the prior art.
Figure 2:
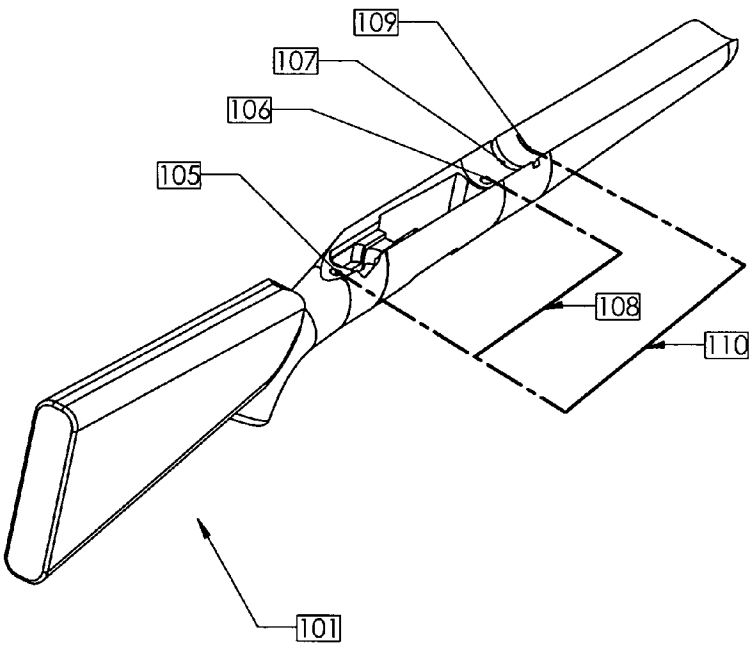
FIG. 2 is a diagram of the inner surfaces of a given stock represented in most bedding procedures as understood in the prior art.

The rifle stock, receiver, recoil lug, and barrel as understood in the prior art are depicted in FIGS. 2 and 3.

Rifle stock 101 of FIG. 2 is manufactured from any one of a number of materials, including but not limited to, wood, synthetic material, molded composite incorporating synthetic fibers, or laminated materials, that serves as a platform to provide housing for the integral components of a rifle of any mechanism including but not limited to the action [bolt action (Remington, Winchester, Sako, and Ruger rifles), single action (Henry, Harrington and Richardson, and Marlin rifles), lever action (Henry and Marlin rifles), semi-automatic actions (Colt, Springfield, Bushmaster, and Armalite rifles)], barrel (Hart, Shilen, Lilja), and trigger guard. Rifle stock 101 may be produced in any configuration including but not limited to hunting and sporting stocks (Remington stocks, Winchester stocks, Model 700 stocks, Model 70 stocks, Ruger Model 77 stocks, Mauser Style stocks, Sako stocks, Weatherby stocks) and competition and tactical stocks (benchrest stocks, silhouette stocks, pistol grip stocks, high power competition stocks, tactical stocks (M40A1 or any generation or variation therein), left-hand stocks, and left-hand hunting and specialty stocks. The rifle stock 101 is defined as a structure created from a plurality of materials for the purpose of creating a platform for the securing of the components of a firearm that facilitates the usage of the critical components of the rifle.

Critical Components of the Rifle

The critical or core components of a rifle are illustrated in FIG. 3, and consist of the receiver 102, the barrel 103, recoil lug 120 and a sighting mechanism (not depicted). As described above, the term action is a used by persons well known to the art as a loose synonym to a receiver. For the sake of completeness, the following definitions are provided. An action is any rifle component or mechanism that accepts a live or spent ammunition round or cartridge and presents said round or cartridge to the firing pin for ignition; the said action consists of the bolt, firing pin, and the receiver 102. The action may be of any configuration including but not limited to bolt action, lever action, single action, block, or semi-automatic action. A bolt is as a part of a rifle, incorporated into the action, that houses a firing pin designed to strike the presented round of cartridge and induce activation or firing of said ammunition; compression of a spring or coil in the bolt provides the potential energy stored by the bolt that when said spring or coil is released, will result in contact between the firing pin and the primer of the ammunition, a process which results in ammunition detonation. The receiver 102 is a machined port configured to accept the bolt, a function which provides the support for the firing mechanism of a given rifle. A trigger guard is as any machined metal or non-metal component designed to surround and protect the trigger mechanism from external influences that may damage the trigger mechanism or result in premature activation and inadvertent ignition of the ammunition; the trigger guard may be constructed in one or multiple parts. A barrel 103 is defined as a machined component that accepts the fired bullet from the cartridge of a given caliber, and has an internal machined surface that forces the said bullet to spin as the said bullet travels through the said barrel. The purpose of the said barrel is to allow for the said bullet to be fired with increased accuracy. The barrel and receiver are mated in the construction of any rifle in the prior art. The said relationship between the barrel and the receiver will be referred to below as the receiver/barrel combination 104. The said interface between the barrel and receiver is reinforced in rifles of the prior art by a component designated as the recoil lug. The said recoil lug 120 supports the interface of the said receiver/barrel combination, when the receiver/barrel combination is bedded within a stock. The recoil lug 120 is thus a critical or core component of the rifle and is described below. The sighting mechanism consists of any modality that is utilized by the operator to aim a given rifle, and is defined by the inherent function of sighting or aiming of the said rifle incorporated in the operation of the said rifle. Sighting mechanisms include but are not limited to open sights, iron sights, scope mounts, and scope. Scope mounts are defined as separate machined parts that are utilized in the securing of the rifle scope to the said barreled action. The rifle scope is noted in the prior art to include but not be limited to optical instruments utilized for the purpose of telescopic vision manufactured by Zeiss, Swarovsky, Nikon, Leopold, Steiner, and other such manufacturers. The implementation of the caliber exchange system 100 allows for the creation of a take-down rifle without the separation of the said critical components of a rifle.

Bonding materials used in Incorporation of Segmentation System

In general, all of the articulations of the caliber exchange system 100, specifically screws via ports, may be strengthened by the application of bonding agents, including but not limited to anaerobic glue, loctite, or other products. The components, once assembled, bonded, and ready for incorporation, may be secured into place with means including but not limited to glass bedding, a process in which a liquid product is applied to locations, and upon drying, allows for the components of the caliber exchange system 100 will be more firmly secured into rifle stock 101. Bedding compounds utilized in the said bedding process include but are not limited to Brownells, Acraglas, Acraglas Gel, Glasbed, SteelBed, MicroSight's MicroBed, DevCon Plastic Steel, and Travaco Marine-Tex. The said bonding compounds may be utilized in the implementation of the caliber exchange system components into the stock 101. The application of the said bonding compounds allows a component to be secured within a given portion of a given stock without the application of an articulating screw. The multiple permanent attachment points of the caliber exchange system 100 that utilize articulation screws may be augmented in function with the usage of numerous joint strengtheners including, but not limited to, anaerobic glue, loctite, or any other permanent glue material.

Limitations of the Bedding Systems Known in the Prior Art

FIG. 2 depicts the internal surfaces of a given stock, as understood in the prior art. The stock contains two separate ports Utilized for the attachment of a receiver/barrel combination to a stock. The two ports are the rear action screw port 105 and the front action screw port 106. The recoil lug port 107 is an additional port that is operable to receive the extension surface of a recoil lug 120. The recoil lug functions to prevent the translation of recoil forces onto the stock, a function that prohibits shear forces from affecting the attachment function served by the screws within the rear 105 and front 106 action screw ports.

The bedding systems in the prior art are narrowed in focus due to the acceptance of the usage of the traditional rear and front action screw port locations. The bedding systems of the prior art utilize the rear action screw port 105, the front action screw port 106, and the recoil lug port 107 in the bedding of a receiver/barrel combination 104 into a given stock 101. The utilization of these specific sites is well understood in the prior art. The traditional bedding systems are narrowed by only considering these three locations in the process, a thought pattern that is understood when one considers that these attachment points are the only said ports available for articulation due to the inherent construction of the said receiver. The bedding surface utilized in the prior art is noted by length 108, the application of various methods within the said length usually resulting in a full length bedding of a receiver.

The traditional bedding practices well known in the prior art utilized to prevent the movement of a given receiver in a stock are narrowed in construct due to the tenant of solely relying on the front and rear attachment screw ports and the recoil lug in the bedding process. The regions available for recruitment into the bedding process are limited due to the physical construction of the receiver, a surface with only the said specific points available for bedding. Due to the narrow length available to create a bedding surface, the most successful techniques have relied on a full length bedding of the receiver, a technique that has been improved upon by a myriad of inventions.

The narrowed scope of the bedding surfaces originates from a limited focus on the problem. In essence, the question all gunsmiths ask is in what manner does an operator address a given receiver/barrel combination to insure that the operation of the said receiver/barrel combination will function with predictable and repeatable results. A stock is utilized to hold the receiver/barrel combination to allow for an operator to address the firing mechanism. Thus, all considerations surround to problem of how to create a uniform surface within a stock that is designed to hold a given receiver. The single receiver is considered to function in a single stock, a relationship which creates a limitation when considering the bedding of a receiver within a stock.

All receivers have a traditional configuration for attachment to a stock, with the traditional points available for attachment consisting of the front and rear action screws and the recoil lug. All stocks contain opposing ports for mating the said receiver to a given stock. Thus, the problem considered by most well known to the art is how to firmly secure a given receiver with a certain inherent, limited number of attachment points available to a given stock with opposing ports and surfaces manufactured in a standard configuration to accept the said attachment points of the receiver. The limited nature of the problem is accepting the traditional geometry of the said receiver and stock. The said limitation is reinforced in the art by viewing a given receiver/barrel combination to be only operable with a single stock. The scope of the problem is expanded when one considers the functionality of a receiver/barrel combination to be operable outside the constraints of a single given stock, a concept that visualizes a receiver/barrel combination to be utilized separated from a stock. When a receiver/barrel combination is removed from a stock (FIG. 3), the entire surface is visualized. The receiver/barrel combination is viewed as a separate entity that is to function independently from a stock. The question then becomes how does one better stabilize the function of the receiver/barrel combination itself, and then how does one utilize the increased stability in the attachment of the receiver/barrel combination to the stock. The solution to the expanded problem is in the creation of a retention housing structure that takes advantage of the reconsidered scope of the functionality of the receiver/barrel combination, and by-pass the constraints of the accepted points of attachment.

The utilization of an additional attachment point is illustrated in FIG. 2, and is shown as a component of the prior art stock to further illustrate the said improvement of the bedding systems in the prior art by the implementation of the caliber exchange system 100.

The intended removal of the receiver/barrel combination from the stock expands upon the limitations of the current bedding surfaces by allowing for the entire undersurface of the said receiver/barrel combination 104 (FIG. 3) to be utilized as a bedding surface. Thus, the surfaces on the barrel side of the receiver/barrel interface may be recruited into the bedding process in the embodiment of the caliber exchange system 100.

The unique embodiment of the caliber exchange system 100 of utilizing an attachment point forward of the traditional front action screw port 106 position is illustrated in FIGS. 2 and 3. As stated above, the improvements are illustrated on the figures representing the prior art in an attempt to illustrate the improvements embodied by the caliber exchange system 100. The recoil lug 120, as described above, is disposed in a position between the receiver and barrel, a position well understood by those with a knowledge of the prior art. The recoil lug axis 112 (FIG. 3) illustrates a key location in the implementation of the improvements embodied by the caliber exchange system 100. As described above, the prior art utilizes the rear action screw port 105 and the front action screw port 106 as the only articulated attachment points between the receiver and the stock in the bedding of an action into the said stock 101. The action screw ports 105 and 106 are positioned on the receiver side of the recoil lug axis 112. The utilization of only the said action screw ports 105 and 106 is the limitation of the previous bedding systems as described above. The said limitation is illustrated by the distance 108 created between the rear action screw port 105 and the front action screw port 106. The caliber exchange system 100 utilizes a port on the barrel side of the recoil lug axis 112 to improve on the said limitations of the bedding systems in the prior art. A full description of the recoil lug axis 112 is discussed below.

Attachment point separation, or the unique embodiment of increasing of the distance between the attachment points utilized to attach a receiver/barrel combination to a stock by the implementation of a separate additional mechanical attachment on the barrel side of the receiver/barrel interface, allows for an improvement on the traditional bedding process as understood in the prior art. The forward attachment point 109 (FIG. 2) is a separate, designated site on the barrel side of the receiver/barrel interface that allows for an increased distance to be created between the rear action screw port 105 position and the forward attachment point 109. The attachment point separation embodiment is illustrated by the length 110 in FIG. 2. The use of attachment point separation allows for a more stable platform to be created for the mounting of a receiver/barrel combination onto a stock, an increased stability that allows for the remaining portions of the receiver/barrel combination to be floated within the stock. The said floatation is defined as a physical separation between two surfaces that allows for the said surfaces to uniformly vibrate in a consistent manner.

Figure 1A:
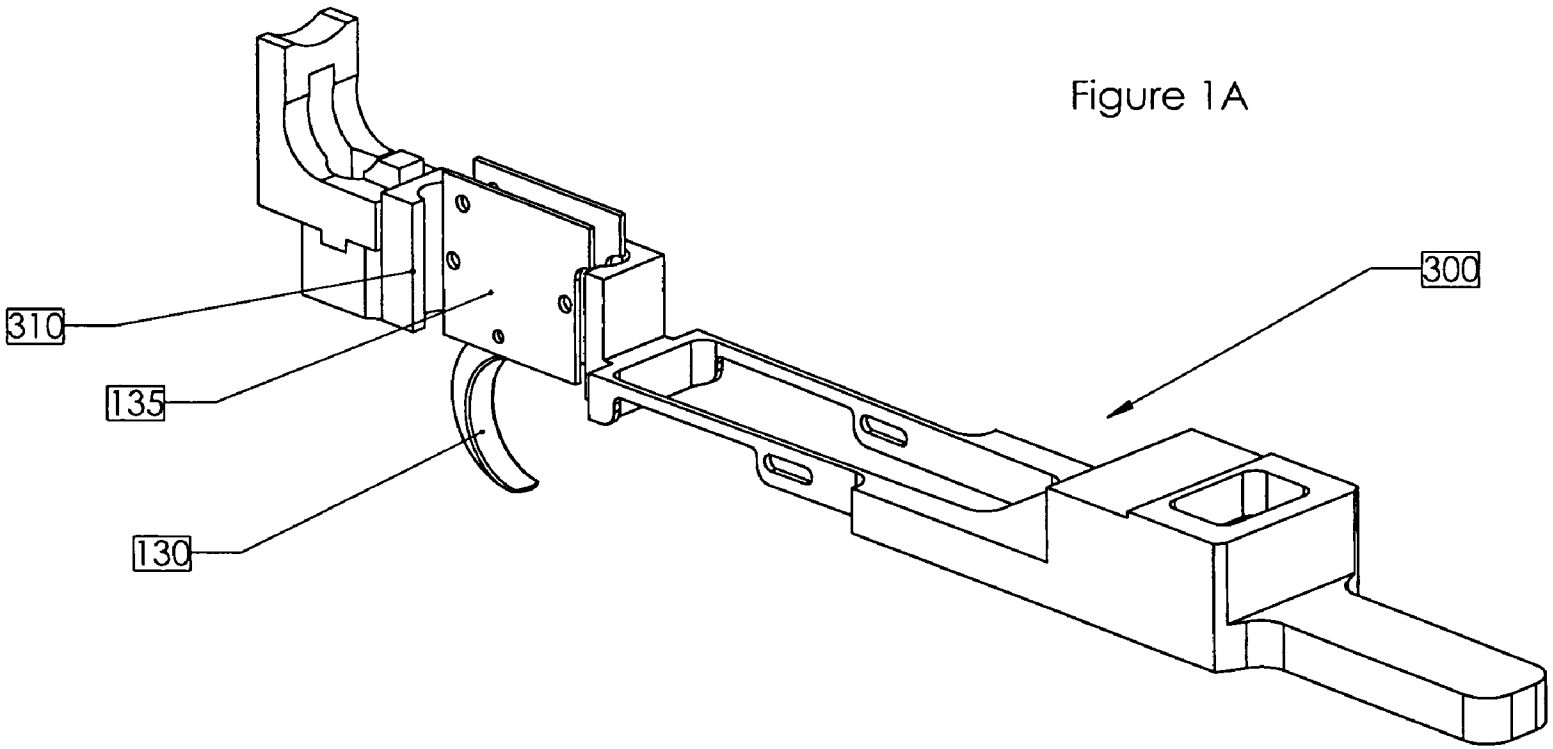
FIG. 1A is a diagram of the lower retention housing of the caliber exchange system depicting the trigger mechanism positioned within the lower retention housing.

FIG. 1A illustrates a further limitation of the bolt-action rifle configuration in the prior art. In the prior art, the trigger mechanism is directly attached to the receiver. As stated above, the said direct attachment configuration insures that the bolt engages trigger mechanism every time that the bolt is operated. The limitations of the configuration prohibit the separation of the said trigger mechanism from the receiver in the prior art. In FIG. 1A, the trigger mechanism 135 of trigger 130 is positioned within the trigger housing 310 of the lower retention housing 300. The said configuration of the caliber exchange system 100 in which the trigger mechanism 135 is separated from the receiver 102 is unique. The implementation of the interrupted bedding system allows for a stable platform to be created in which the trigger mechanism 135 may be separated from the receiver 102. Upon the selective removal and attachment of the major components of the caliber exchange system 100, the trigger mechanism 135 is positioned within the receiver 102 in a precise arrangement that is repeatable, a level of precision that allows the trigger mechanism 135 to seat within the receiver 103 with predictable and repeatable results. The stability of the interrupted bedding surfaces allows for the separation of the trigger mechanism from the receiver.

Figure 4:
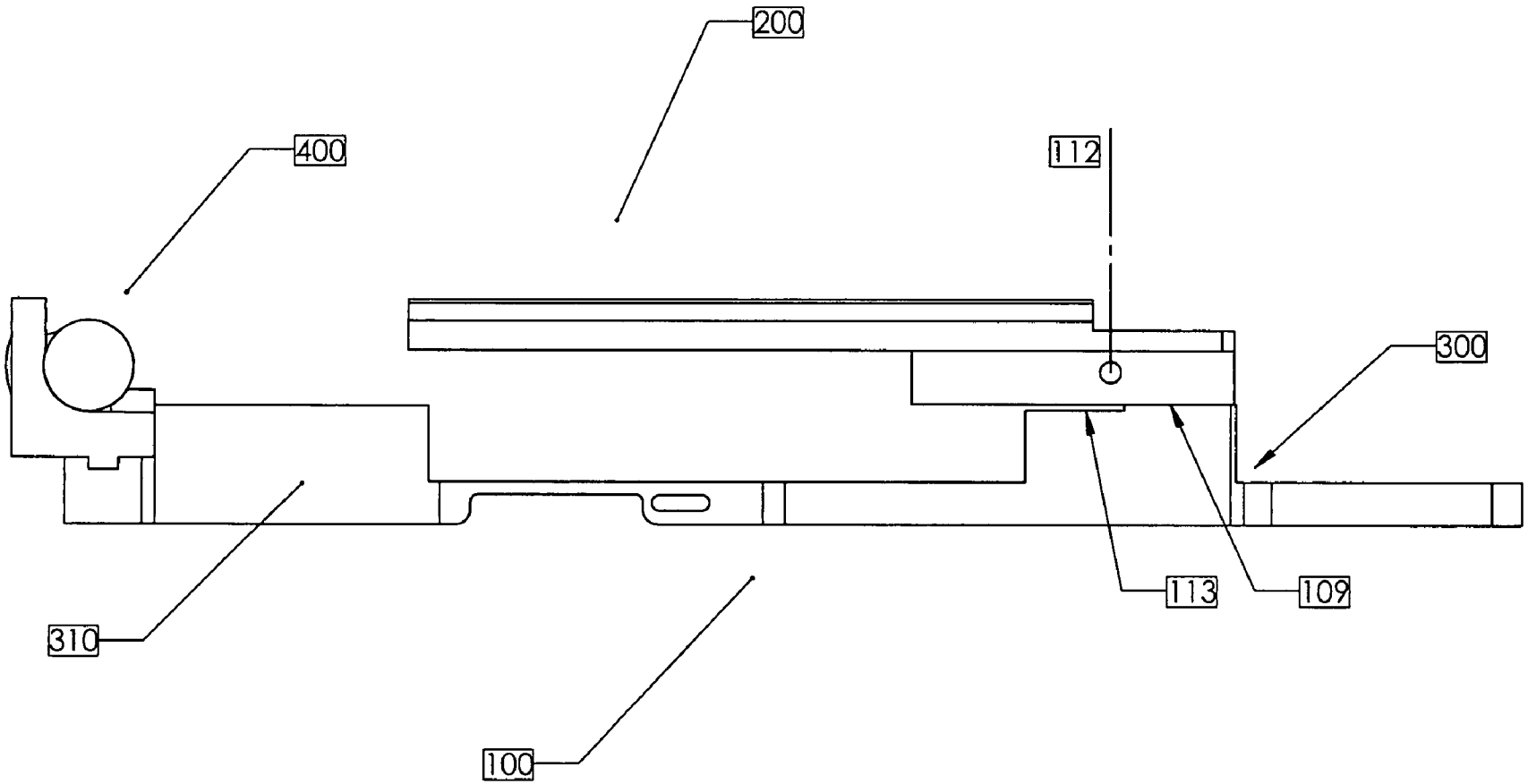
FIG. 4 is a profile view of the caliber exchange system illustrating the floatation of the entire receiver and upper plate within the lower retention housing with the stock, receiver and barrel not pictured.

FIG. 4 is a diagram of the profile view of the caliber exchange system 100 with the upper and lower retention surfaces selectively attached, a diagram that is included to reinforce the concept of the floatation of the entire length of the receiver/barrel combination. For clarity, the receiver is omitted. The caliber exchange system 100 major components are illustrated: the upper retention housing 200, the lower retention housing 300, and the rear attachment elements 400. The surface mating between the upper and lower retention housings at the forward attachment site is exaggerated for clarity. The forward attachment point 109 is the machined element that houses the forward attachment components, and is discussed further below. The surface 113 of the lower retention housing is depicted in a fashion to illustrate the full length floatation of the receiver/barrel combination. The surfaces surrounding the forward attachment site 109 on the lower retention housing are machined in a precise manner to allow for a space of several millimeters to be created between the opposing surfaces of the upper and lower retention housings. The floatation extends forward of the recoil lug axis 112 up to the immediate region surrounding the forward attachment point 109.

Barrel Switch Concept of Prior Art

As stated previously, take-down rifles in the prior art are created by one of two separate means: segmentation of the stock itself and/or the separation of the barrel from the receiver. The segmentation of the stock itself is performed in the prior art by segmenting the stock into a butt section and a fore-end section, with the fore-end section usually containing the action and the barrel. The separation of the barrel from the action is well known in the art and has been improved on by many patents. The key focus of the modalities that involve separation of the barrel and the action is the creation of a platform that will allow the action and barrel to mate precisely and with repeatability so that the barrel is attached to the action the same way every time the two components are approximated for attachment. The barrel and action must fit precisely together to eliminate wear on the parts with usage and to maintain accuracy. For if the barrel and receiver do not fit precisely together, the accuracy will not be consistent and the platform will have increased wear.

The separation of the action from the barrel is a configuration also utilized in some caliber exchange systems. A platform that utilizes a barrel exchange to allow for an additional caliber to be utilized is known in the prior art as a barrel switch configuration. In the barrel switch, a given barrel of a given caliber is exchanged for an additional barrel of a different caliber. This exchange also necessitates the exchange of the bolt face to accommodate a new caliber, for one may not simply just switch a barrel to gain a new caliber without affecting the action itself. The action is affected by the switch because the bolt face, or the mechanism which holds the rear portion of the cartridge, must also be adjusted to fit different calibers. Thus, the barrel switch configuration necessitates the exchange of a barrel and an alteration of the bolt face.

Several major problems exist with the barrel switch configuration. First, one must have a barrel and a bolt-face for each caliber to be utilized. The configuration will not function without both of the components. The separation of the barrel from the action allows for the possibility of losing one or both of the said components which would make the system inoperable. Thus, the system would not function if either the replacement barrel or the altered bolt were lost in the field. Second, the separation of the barrel and the action necessitates the platform to be sighted in after each exchange. Each rifle is sighted in, or the scope or open sight adjustments are made on the firearm so that the operator will be able to place a bullet in an exact and repeatable location. The rifle is sighted in to allow for the operator to know the exact location that a bullet will hit at a given distance as the bullet travels downrange. Each caliber utilized will have a different ballistic performance, or the way in which a bullet travels as it travels through the barrel, travels in flight downrange, and then when the bullet hits the target. Thus, when the barrel switch is performed, a separate caliber is used, and the platform must be sighted in accordingly to allow for predictable function. Lastly, the usage of multiple parts creates an inherent danger to the operator as there is a possibility of using the wrong barrel and bolt combination. If one were to insert a cartridge into a barrel that was designed for a separate caliber, the resulting performance may be fatal to the operator. Thus, the usage of multiple components presents an inherent danger to the operator.

The caliber exchange system improves upon these limitations by creating a system in which the barrel and receiver are not separated during the said caliber exchange function. The caliber exchange system avoids the unsupported usage of multiple barrels and bolt faces, a fact which avoids the loss of the said components in the field. The caliber exchange system will allow for the caliber exchange process to proceed without the necessity of having to re-sight in the platform after the said exchange. Lastly, the caliber exchange system is safer to use, as all of the components are to remain fixed and will not allow a barrel to be used with a wrong bolt, assuming that the proper and intended usage of the platform is maintained by the operator. An operator may insert the wrong caliber into any firearm with the said predictable results. The caliber exchange system limits this problem to the levels inherent in the usage of a regular factory produced firearm.

A receiver 102 is joined to a barrel 103 by a threaded attachment, joining the distal end of the receiver to the proximal end of the barrel. The threaded attachment secures the said barrel to the said receiver in permanent joint that is to be maintained for the usable life of the said receiver and barrel. A barrel 103 may be separated from the receiver 102 in order to be replaced, after the barrel has been worn from overuse. In the operation of the caliber exchange system, the interface of the receiver and barrel is to be considered a permanent joint, not to be separated unless to replace either the receiver or barrel due to overuse. The maintaining of the receiver/barrel interface allows for increased accuracy in the utilization of the caliber exchange system, as the critical components of the rifle, the receiver, barrel, and sighting mechanism, are allowed to be maintained in function.

The said functionality of maintaining the interface between the receiver and barrel is a direct contrast to a barrel switch configuration described above, a platform that utilizes a separation of the receiver from the barrel, with replacement of an additional barrel to provide the functionality of a caliber exchange. The maintenance of the receiver/barrel interface during the caliber exchange allows for the key components of the rifle, the receiver, barrel, and sighting mechanism, to be maintained as a unit, a configuration which holds many benefits over the said barrel switch configuration. When the receiver/barrel interface is maintained, each receiver/barrel combination will be allowed to maintain its zero, or the point of impact determined by the pre-calibration of the sighting mechanism. Thus, a given receiver/barrel combination of a given caliber will not need to be sighted-in when the said combination is replaced by an additional given receiver/barrel combination of a different caliber. Further, accuracy is maintained during the exchange due to the configuration in which the critical components of the system are kept physically contiguous during the said exchange. Lastly, the maintenance of the receiver/barrel interface prevents overuse and additional wear of the individual components, a complication that may occur with the separation and replacement of the components in the barrel switch configuration.

Thus, the caliber exchange system creates a platform in which the bedding system itself is utilized in the creation of a take-down rifle, a configuration which avoids the segmentation of a stock and the said separation of the action from the barrel.

The Receiver/barrel interface

The receiver/barrel interface 111 (FIG. 3), or the interface created by the joining of the receiver 102 and barrel 103, is one of the key elements of increasing the accuracy of a firearm. The receiver and barrel must be joined together with extreme precision in order to insure accuracy. The process of blueprinting an action, or the truing and squaring of the interface between the receiver and the bolt, is beyond the discussion necessary for describing the functionality of the caliber exchange system. However, for the sake of completeness, blueprinting is a process that includes insuring that the barrel threads are cut on the same centerline as the bolt throughhole, the face of the bolt is concentric and at an exact right angle with the centerline of the bore, the locking lug recesses are perfectly perpendicular to the centerline, the locking lugs mate completely and squarely with their recesses, the face of the receiver is square with the centerline, and that the washer-type recoil lug has parallel sides so that when the receiver and barrel are tightened the centerline of the bore is maintained with the centerline of the receiver. In short, blueprinting insures that the operation of the bolt within a receiver will position the cartridge and bolt-face with exact precision within the interface between the receiver and the bolt. Thus, the maintenance of the interface between the receiver and the barrel is crucial to the production of accuracy of a firearm, a process which will insure that each round is fired in a repeatable fashion. A barrel is often replaced at the same time that a receiver is blueprinted, a fact which insures that the face of the barrel will mate perfectly with the receiver. Thus, the stabilization of the receiver/barrel interface is crucial to the maintenance of accuracy of a firearm. The caliber exchange system utilizes a retention element to further stabilize the receiver/barrel interface, a purpose that insures the maintenance of accuracy throughout the exchange process.

A recoil lug 120 (FIG. 3), well know in the prior art in position and function, is applied at the receiver/barrel interface 111. Whether machined as an integral component of the receiver or machined as a separate component, the purpose of the recoil lug is to stabilize the interface between the receiver and barrel during recoil and to prevent the transfer of shear forces onto the attachment surfaces between the receiver/barrel combination and the stock. In the prior art, the recoil lug thus forms a conceptual division between the receiver and the barrel at the said interface. The recoil lug 120 is usually an individually machined component that extends inferiorly into the stock and is used during the bedding process to firmly seat a receiver/barrel combination into a stock. Thus, the recoil lug axis 112, or the line extending superiorly and inferiorly at the interface between the receiver and the barrel that is oriented perpendicular to the long axis created by the alignment of the said receiver and barrel, is the usual end-point of the application of all bedding systems within the prior art. Whereas some bedding systems include the recoil lug itself or the likeness of the recoil lug in its operation, no conceptual entity of a bedding system extends beyond the immediate recoil lug axis, a location that includes the functionality of the recoil lug itself. A variant of the bedding process may provide a surface at the proximal portion of the barrel, but a separate attachment screw on the barrel side of the recoil lug axis is not used. The unique embodiment of the caliber exchange system is to utilize a position on the barrel side of the recoil lug axis, a position that is separate from the functionality of the recoil lug, to form an independent attachment point between the receiver/barrel combination and the stock.

Macro-view of NEW CES

The caliber exchange system 100 utilizes a unique interrupted retention housing to selectively separate the receiver/barrel combination 104 from the stock 101. The interrupted retention housing allows for the usage of a unique attachment point location that serves to lengthen the distance between the two separate attachment points between the interrupted retention housing, creating a platform whose unique attribute is to create a more stable mounting surface for the attachment of a receiver/barrel combination to a given stock. The stability created by the increased distance between the attachment points allows for the mating of a receiver/barrel combination to a stock without the utilization of traditional bedding procedures. Further, the selective detachment of the receiver/barrel combination from the platform allows for increased portability of the firearm and for the ability to operate multiple caliber groups from a single firing platform.

The caliber exchange system 100 (FIG. 1) utilizes two separate retention housings to support the receiver/barrel combinations: an upper retention housing 200, operable to support a given receiver/barrel moiety 104 (FIG. 3), and a lower retention housing 300, operable to be based within the stock 101 (FIG. 2). The intended separation of the receiver/barrel unit from the stock allows for the utilization of the entire surface of the said combination, a unique principle which allows for an attachment screw port to be positioned on the barrel side of the recoil lug axis. The attachment screw port positioned on the barrel side of the recoil lug axis is depicted in FIG. 2 as the forward attachment point 109. The unique position of the forward attachment screw port allows for an articulation point between the receiver/barrel combination and the stock that is longer in distance than the traditional configuration of the said rear and front action screw ports, locations positioned correspondingly due to the institutionalized configuration of the receiver attachment points. As above, the rear action screw port is traditionally positioned in the receiver to the rear of the trigger port, and the front action screw port is positioned in the receiver on the receiver side of the recoil lug axis. By intentionally extending the inferior surface under the receiver anteriorly to a point at the barrel side of the receiver/barrel interface, a more stable surface for attachment is created. Attachment point separation is the embodiment of the caliber exchange system used to describe the increased distance created between the primary attachment points securing the receiver/barrel combination to the stock.

Upper Retention Housing

The upper retention housing 200, illustrated in FIG. 5, is utilized to stabilize the receiver/barrel interface 111, a joint whose maintained integrity is crucial for the accuracy of a firearm. The upper retention housing 200 is an elongated structure with multiple individually machined ports. The upper retention housing 200 is operable to permanently be joined to a given receiver/barrel combination, a configuration that is articulated by a front action screw port 210 positioned on the receiver side of the recoil lug axis and a recoil lug articulation port 220 positioned on the recoil lug axis. A single upper retention housing is mated to a given receiver/barrel combination of a given caliber. The interface between the receiver/barrel combination and the upper retention housing is permanent and functions to stabilize the receiver/barrel interface during the selective separation of a given receiver/barrel combination from a given stock. The upper retention housing 200 is operable to also provide the surface for a screw attachment on the barrel side of the recoil lug axis for the attachment of the said receiver/barrel combination to the stock, a position referenced as the forward attachment point 109.

Thus, the upper retention housing 200 is a critical element in the embodiment of the caliber exchange system as it provides a surface for the stabilization of the receiver/barrel interface and a location for the implementation of attachment point separation. Attachment point separation is created by anteriorly extending the surface beneath the receiver to include a separate attachment site on the barrel side of the receiver/barrel interface 111, the attachment point depicted as the forward attachment point 109. The unique principles embodied in the implementation of the upper retention housing allow for a stable platform on which to utilize the caliber exchange system, a configuration in which a single upper retention housing permanently joined to a given receiver/barrel combination of a given caliber is selectively mated to the lower retention housing, a union which may be separated at the demands of an operator and one receiver/barrel combination of a given caliber may be substituted for an additional receiver/barrel combination of a different given caliber.

The receiver attachment ports are depicted in FIGS. 6 and 7. FIG. 6 is a top view of the upper retention housing 200. FIG. 7 is a bottom view of the upper retention housing 200. The receiver attachment ports, the front action screw port 210, the recoil lug articulation port 220, and the middle action screw port 240, are addressed below. The receiver attachment ports serve to permanently attach a receiver 102 to the upper retention housing 200. The said permanent attachment may be reversed in order to service wear of the parts, replacement of any of the said parts, or for cleaning and general maintenance of the said parts. The receiver attachment ports are attachment ports that are permanent in application and are not utilized in the selective separation of the receiver/barrel combination from the stock.

Front Action Screw Port

The front action screw port 210 is positioned on the receiver side of the receiver/barrel interface 111, a location that is understood in the prior art to be one of the two main attachment points between the receiver and the stock. The front action screw port 210 on the upper retention housing 200 is utilized to permanently anchor the receiver to the upper retention housing. The permanent bond may be removed for the purpose of maintenance or replacement of worn components. The upper retention housing is attached to the receiver by the articulation of the front action screw through the front action screw port and into the receiver. The said attachment secures receiver 102 to the upper retention housing 200 at the receiver side of the recoil lug axis, an attachment surface that functions to stabilize the receiver/barrel interface 111.

An additional attachment point may be utilized to further support the bond between the receiver/barrel combination and the upper retention housing 200. Traditionally, the receiver has only two machined ports for the accepting of the rear and front action screws, the said rear action screw located on the receiver to the rear of the trigger port, and the front action screw port located on the receiver at the receiver side of the recoil lug axis. In the present embodiment, an additional action screw port may be machined into a given receiver. The middle action screw port is machined in the receiver in the location between the trigger port and the magazine port. A corresponding middle action screw port 240 is machined into the upper retention housing 200 to be operable to the said middle action screw port of the receiver. The middle action screw port is positioned to stabilize the interface between the rear portion of the upper retention housing 200 and the receiver 102. The need for the utilization of the middle action screw port depends on the length of the upper retention housing that is used, as the upper retention housing may be used in a configuration that extends rearward only to the point immediately anterior to the magazine port. In the additional short upper retention housing configuration (not depicted), the front action screw port would be sufficient for the stabilization of the upper retention surface to the receiver/barrel combination. Thus, the middle and front action screw positions serve to firmly anchor the receiver/barrel combination to the upper retention housing, an interface which serves to strengthen the rigidity of the receiver/barrel interface.

Recoil Lug Operation

The inventive principles of the recoil lug are described in depth below in an additional configuration of the caliber exchange system 100. A brief description is presented in the current discussion in order to completely describe the functions of the upper retention housing 200.

The recoil lug 120 (FIG. 3) is positioned at the receiver/barrel interface 111 and is utilized as an articulated entity to firmly secure the receiver/barrel interface 111 to the upper retention housing 200. The articulation of the recoil lug 120 to the upper retention housing utilizes the following: the recoil lug extension surface that includes an individually machined recoil lug accepting port, the recoil lug articulation port 220 located on the upper retention housing at the recoil lug axis, the recoil lug attachment port 230 positioned in the upper retention housing on a plane perpendicular to the recoil lug axis, and the recoil lug attachment screw. The operation of securing the recoil lug within the upper retention housing 200 is addressed in the following discussion. The recoil lug 120 is positioned within the recoil lug axis at the interface of a given receiver and barrel 111. The recoil lug extension surface is mated with the recoil lug articulation port 220 on the upper retention housing 200. The recoil lug extension surface is firmly seated within the upper plate by the geometry of the separate machined recoil lug articulation port 220. The recoil lug attachment screw is articulated through the recoil lug attachment port 230 of the upper retention housing 200, advanced through the recoil lug extension surface positioned within the recoil lug articulation port 220 via the recoil lug accepting port, and into the opposite side of the upper retention housing 200. All of the said articulating surfaces are to be augmented by the application of anaerobic glue or loctite. The articulation of the recoil lug to the upper retention housing is a permanent joint, an articulation which may be released to replace the barrel but is to be permanently maintained through the function of selectively removing the receiver/barrel combination from the stock. Thus, the attachment of the recoil lug to the upper retention housing 200 is an attachment surface and not a mating surface.

The function of the recoil lug in its bond to the upper retention housing is unique in that the said recoil lug 120, operated in the above description, is utilized only to secure the receiver/barrel interface 111 at the recoil lug axis, a function that serves to stabilize the said joint between the receiver and the barrel. The said recoil lug is not utilized for the purpose of bedding of the receiver/barrel combination into the stock, a function that is the utilization of the recoil lug in the prior art. The embodiment of the said recoil lug as a method to stabilize the receiver/barrel interface, and not as a means of transferring recoil to the stock, is central to the embodiment of the principles inherent in the implementation of the caliber exchange system. Thus, in the caliber exchange system 100, the recoil lug at the traditional location of the recoil lug axis is not utilized to transfer recoil, but merely to stabilize the receiver/barrel interface 111, a function activated by intentionally implementing an articulating screw through the recoil lug. A person reasonable skilled in the art would recognize the functionality of the recoil lug in the present invention as a stabilization method to maintain the integrity between the receiver/barrel interface 111 and the upper retention housing 200, and not as a method to solely transfer recoil to the stock. Further, the recoil lug is not utilized in the present embodiment as a means of directly bedding the receiver/barrel combination to the stock. The interrupted retention housings are operable to perform the bedding functions. The forward attachment point 109, located on the barrel side of the recoil lug axis and independent in functionality from the said recoil lug, is utilized as one of the two primary attachments of the receiver/barrel combination to the stock.

Receiver/barrel Interface Stabilization

The utilization of the said receiver attachment ports (the front action screw port 210, the middle action screw port 240, and the said recoil lug attachment operation) function to firmly anchor the receiver 102 to the upper retention housing 200. The securing of the upper retention surface to the receiver/barrel combination via the front action screw port 210, positioned on the receiver side of the recoil lug axis, and the recoil attachment operation along the recoil lug axis functions to stabilize and maintain the integrity of the receiver/barrel interface 111. The strengthening of the said interface creates a stable platform for the utilization of the interrupted retention housings. The strengthening and stabilization of the receiver/barrel interface allows for the anterior extension of the receiver/upper retention housing surface to a point on the barrel side of the receiver/barrel interface 111, an embodiment of the present invention which allows for attachment point separation to be created with the implementation of a forward attachment port located in the forward attachment point 109. Further, the increased stabilization of the receiver/upper retention housing interface by the application of the receiver attachment points allows for the forward redistribution of the recoil forces along the upper retention housing 200 to the forward attachment point 109.

Forward Attachment Screw Port Description

The forward attachment screw port 250 is depicted in FIG. 7. The forward attachment screw port 250 is positioned on the upper retention housing 200 on the barrel side of the receiver/ barrel interface 111 (FIG. 5). The forward attachment screw port 250 is one of two primary attachments between the upper and lower retention housing components. As described above, the removal of the receiver/barrel combination from the stock allows for the utilization of the entire surface of the said receiver/barrel combination. The receiver attachment ports firmly secure the receiver/upper retention housing interface, stabilizing the receiver/barrel interface, and allow for the anterior extension of the upper retention housing along the undersurface of the receiver. The said anterior extension of the upper retention housing allows for the unique implementation of the forward attachment point 109 (FIG. 5), an active, articulating attachment point located on the barrel side of the receiver/barrel interface 111.

The forward attachment screw port 250 (FIG. 7), positioned on the barrel side of the recoil lug axis, allows for the unique stabilization inherent in the implementation of the interrupted housing components in the operation of the caliber exchange system. The attachment point separation, or the increased distance created between the primary attachment points securing the receiver/barrel combination to the stock (length 110 of FIG. 2), creates a more stable platform for the mounting of a receiver/barrel combination to a stock and eliminates the need for the traditional methods of bedding. A further benefit of the attachment point separation is allowing the non-articulated portions of the receiver/barrel combination to be free-floating. Thus, the receiver/barrel combination is anchored to the stock via two separate articulation points between the retention housing components with a free-floating segment in the middle. The free-floating of the receiver allows for the entire receiver/barrel combination, save for the two main attachment points, to vibrate uniformly upon the firing of the weapon, a relationship which increases the overall accuracy of the platform.

Recoil Transfer Extension on Upper Retention Housing

The recoil transfer extension 260 of FIGS. 5 and 7 is an additional embodiment of the upper retention housing 200 and is located on the inferior margin of the upper retention housing at the forward attachment point 109. The recoil transfer extension 260 is depicted in a position on the barrel side of the receiver/barrel interface 111. The unique position increases the stability of the system by supporting the said attachment point separation. The recoil transfer extension 260 allows for the transferring of the recoil forces to the stock, a relationship that prevents shear forces from affecting the said attachment screw components. The recoil transfer extension 260 is further discussed below.

Magazine Port on Upper Retention Housing

A magazine port 270 may be utilized with the upper retention housing 200. The magazine is to be inserted from the inferior portion of the stock, up through the interrupted retention housing surfaces, and into the receiver of a given receiver/barrel combination. The magazine port 270 is positioned so that no portion of the actual magazine physically contacts the upper retention housing or receiver, a fact which allows for the maintenance of the free floating of a given receiver/barrel combination.

Lower Retention Housing

The lower retention housing 300 is depicted in FIGS. 9-11. The lower retention housing permanently mates with the stock to form a stable platform for the operation of the caliber exchange system 100. FIG. 9 is a three-dimensional view of the lower retention housing 300, FIG. 10 is a bottom view of the lower retention housing 300, and FIG. 11 is a top view of the lower retention housing 300. The lower retention housing is to be permanently secured to the stock, a union which forms an immobile platform within a given stock 101. The stationary, permanent bedding of the lower retention housing into the stock allows for a solid support surface for the application of a given upper plate/receiver/barrel combination of a given caliber, a given combination which may be selectively removed and replaced by another given caliber group. The stable platform allows for the utilization of three important functions: the securing and stabilization of the two attachment points, the presentation of the trigger mechanism to the receiver in a precise and repeatable fashion, and allowing for the exchange platform to operate independently from the possible affects of temperature, humidity, and other weather elements that are well known in the prior art to affect the relationship between various stock materials and a given bedding technique. The metal to metal mating accomplished at the attachment sites between the upper and lower retention housing surfaces allows for the firearm platform to operate independently from any weather condition in a repeatable and predictable manner.

As depicted in FIGS. 9-11, the main elements of the lower retention housing 300 are the trigger housing 310, magazine port 320, recoil transfer extension pocket 340, forward attachment port 350, and rear superior pillar bushing port 360. The lower retention housing 300 is unique in that it also serves as a trigger housing for the trigger mechanism, a configuration in which the trigger mechanism is supported independently from a given receiver/barrel combination. The separation of the trigger mechanism from a given receiver/barrel combination allows for the same trigger to be utilized with multiple individual receiver/barrel combinations. Due to the said unique arrangement, the trigger pull, or the dynamic changes of creep, overhaul, and travel that are unique to each individual trigger as felt by the operator, is maintained throughout the use of multiple calibers. Thus, the use of each caliber will feel the exact same to the operator, a fact which will lend to consistent accuracy between the variable calibers utilized on the single platform. The recoil transfer extension pocket 340 positioned in the lower retention housing will accept the recoil transfer extension from the upper retention housing, a relationship that will allow the transfer of the recoil forces through the interrupted retention surfaces to the stock and will prevent shear forces from acting on the attachment screws.

Trigger Housing

The trigger housing 310 is depicted in FIG. 9. The in-situ position of the trigger mechanism 135 is illustrated in FIG. 1A. The position of the trigger within the lower plate is unique to the caliber exchange system 100. As noted in the prior art, the trigger mechanism is usually maintained in continuity with the receiver with the said trigger directly attached to the receiver in the trigger port. In the prior art, the relationship between the trigger position and the rear portion of the receiver must be maintained as a constant because the bolt must engage the trigger mechanism exactly in order for the rifle to function properly. If the bolt is allowed to travel across the trigger housing without actively engaging the trigger mechanism, the firearm will fail to function. Thus, in the prior art, the separation of the trigger from the receiver is not attempted for fear of a misfire. Attempts have been made by several gunsmiths to separate the receiver and trigger mechanism, but have all led to failure due to the inability to consistently present the trigger mechanism to the bolt face. The usage of the lower retention housing provides a method to overcome the previous said limitations.

The unique embodiment of the lower retention housing 300 in the utilization of the caliber exchange system 100 allows for a solid platform to be created in the stock. The uniform, solid platform provided by the lower retention housing 300 permits the selective attachment of a given receiver/ barrel combination to the lower retention housing 300 in a very precise and repeatable arrangement. The interrupted retention surfaces allow for the receiver/barrel combination to be attached to the stock with a high level of precision, a relationship that allows for the trigger mechanism positioned in the lower retention housing 300 to be presented in an identical and repeatable fashion to the bolt elements. The trigger mechanism is firmly attached to the trigger housing 310 of the lower retention housing 300. This precise, repeatable arrangement allows for the trigger mechanism to the engaged with each pass of the bolt, eliminating the previous limitations that resulted in misfire. In short, the stability created by the implementation of the lower retention housing allows for the trigger mechanism to be delivered through the trigger port of a given receiver in an exact and reproducible fashion. Once the attachment points between the interrupted retention surfaces are selectively secured, the trigger mechanism is presented to the bolt as if there was no original separation of the trigger mechanism from the receiver.

Due to the high tolerances in machining the upper and lower retention surfaces, the receiver 102 is allowed to mate with the trigger housing 310 with each engagement and removal of a caliber group. Thus, the implementation of the upper and lower retention surfaces eliminates the said prior limitation of the trigger position. The unique configuration allows for the trigger to be maintained within the stock, a relationship that allows for the same trigger pull, or feel of the operator upon engaging the trigger mechanism, to be constant between each caliber group.

Magazine Port in the Lower Retention Housing

The magazine port 320 in the lower retention housing 300 allows for the application of a magazine into the system. The magazine, as described above, is inserted through the magazine port 320 in the lower retention housing and is locked in place. Positive external force is required on the part of the operator to remove the said magazine from the lower retention housing 300, a fact which prevents inadvertent release of the magazine during the operation of the firing platform. The magazine is presented into the receiver 102, through magazine port 270 in the upper retention housing 200, without contact between the said magazine and the receiver, allowing for the maintaining of the floatation of the receiver/barrel combination. The walls of the magazine port 320 insure that proper feeding of the magazine occurs with each insertion, allowing for the superior surface of the magazine to be positioned within the receiver without any contact between the magazine and magazine port 270 and the receiver 102. Thus, the configuration of the magazine port 320 allow for the precise insertion of a given magazine into the system.

In order to standardize the caliber exchange system, the same size magazine is implemented for the entire range of calibers to be chosen by the operator. The difference inherent in the size of the cartridge cases among the calibers is managed by spacers that are inserted into the magazine. Thus, every cartridge of each variable caliber utilizes the same magazine.

Recoil Transfer Extension and Pocket

Recoil is transferred through the system by the utilization of the recoil transfer extension components. The recoil transfer extension 260 of the upper retention housing 200 is depicted in FIG. 5. The recoil transfer extension pocket 340 of the lower retention housing 300 is depicted in FIG. 9. The embodiment of the recoil transfer extension of the caliber exchange system 100 allows for the transfer of recoil from the receiver, through the interrupted retention housing surfaces, and into the stock. The position of the recoil transfer extension components is depicted in the said FIGURES to be located in a position, including but not limited to the described embodiment, on the barrel side of the receiver/barrel interface 111. The forward attachment point 109 of the upper retention housing 200 (FIG. 5) is the opposing surface to the forward attachment platform 330 of the lower retention housing 200 (FIG. 9). An additional embodiment of the caliber exchange system 100 described below utilizes a pillar bushing configuration to transfer recoil through the system. Thus, the likeness of the recoil transfer elements may be positioned at any point along the interface between the upper and lower retention housing surfaces.

The recoil transfer extension 260 is located on the inferior margin of the forward portion of the upper retention housing 200. The recoil transfer extension 260 is machined to be operable with the recoil transfer extension pocket 340 located in the forward portion of the lower retention housing 300. The unique position of the recoil transfer extension embodiment increases the stability of the system by supporting the said attachment point separation. The recoil transfer extension components allow for the transferring of the recoil forces to the stock, a relationship that prevents shear forces from affecting the said attachment screw components.

The mating of the surfaces of the recoil transfer extension embodiment of the caliber exchange system is addressed below. The recoil transfer extension 260 is a machined component on the upper retention housing 200. The upper retention housing 200 is permanently joined to a given receiver/barrel combination, and the said body is selectively attached to the lower retention housing 300 via the attachment components positioned in the rear action screw port location and the forward action screw port location, a relationship that will be addressed below. The recoil transfer extension 260 of the upper retention housing is machined to function as a geometric mate within the recoil transfer extension pocket 340 in the lower retention housing 300. Upon the application of the said attachment surfaces between the interrupted retention surfaces, the recoil transfer extension 260 is mated with the recoil extension pocket 340. The mating of the recoil transfer extension with the recoil extension pocket forms a load bearing surface that functions to transfer the recoil force through the system and to prevent shear forces from acting on the said attachment surfaces.

The recoil transfer extension pocket 340 depicted in FIG. 9 is positioned on the forward attachment platform 330 of the lower retention housing 200. As previously discussed, the superior surface of the forward attachment platform 330 is machined in a fashion such that the only contact between the forward portions of the upper and lower retention housing surfaces is surface immediately surrounding the recoil extension pocket 340. The forward attachment platform 330 is shaved of several millimeters along the superior surface, except for the said portions immediately surrounding the recoil extension pocket 340. The said interface is represented by surface 113 of the lower retention housing 300 in FIG. 4. Thus, the receiver/barrel combination is allowed to float freely in the region between the two attachment points.

The mating configuration of the recoil transfer extension embodiment is to be considered a screw-less joint that is only to provide a load bearing surface for the transferring of recoil to the stock and the prevention of recoil shear forces from acting on the attachment points between the upper and lower retention housing surfaces. The distinction is important and is central to the implementation of the caliber exchange system 100, as the recoil transfer extension elements serve a separate distinct function from the forward attachment point elements. The recoil transfer extension elements are depicted as being associated with the forward attachment point elements, but the functionality of the two said embodiments may be separated in other configurations of the inventive principles of the caliber exchange system 100.

The functionality of the forward action screw port and the recoil extension embodiment are depicted in the figure with overlapping functions. The forward attachment screw port 250 on the upper retention housing 200 is positioned within the recoil transfer extension 260 (FIG. 5), and the opposing forward attachment screw port 350 on the lower retention housing 300 is positioned within the recoil extension pocket 340 (FIG. 11). Thus, the likeness of the combined embodiments of the forward action screw ports and the recoil transfer extension elements is analogous to the pillar-bushing principle discussed below. The likenesses of the embodiments of the forward action screw port and the recoil extension elements are thus combined in function, but each serve a distinct separate function as previously addressed. The orientation of the two said elements is depicted as combined. However, variants of the configuration may also be used that separate the said functions, such that the likeness of the recoil transfer extension may be utilized as a screw-less pillar bushing attachment located at any point along the surface between the interrupted retention housing elements, and the forward attachment port may be utilized as an individual port located on the barrel side of the receiver/barrel interface. Thus, the embodiments of the caliber exchange system are presented in the above depicted form, but the principles may be individually applied via separate configurations.

The Mating Surfaces Between the Interrupted Retention Housings

A concept central to the implementation of the embodiment of the caliber exchange system is the location and orientation of the attachment points between the interrupted retention housing surfaces. The unique positioning of the attachment points is derived from the increased distance created between the said attachment points by the implementation of the upper retention housing. As stated above, attachment point separation is created by the positioning of a forward attachment screw port on the barrel side of the receiver/barrel interface within the upper retention housing, a position created by the anterior extension of the receiver/upper retention housing interface to the region on the barrel side of the said recoil lug axis. The attachment point separation allows for a platform to be established that increases the stability of the system. The increased distance between the attachment points allows for the receiver/barrel combination to be mated with a given stock in a fashion that dispenses with the need for the bedding techniques understood in the prior art.

As depicted in FIG. 1, the caliber exchange system 100 consists of three major components: the upper retention housing 200, a component that is operable to be permanently attached to a receiver 102; a lower retention housing 300, operable to be permanently attached to a given stock 101; and the rear 400 and forward 500 attachment elements, elements operable to form two separate widely spaced attachment points for the selective attachment of a given receiver/barrel combination to a stock. Selective attachment is defined as the intended separation and articulation of the receiver/barrel combination from the stock, a relationship that requires independent operation by a user in order to purposefully separate the firearm platform into two major components for the creation of a take-down rifle. The two major components that are created are the receiver/barrel combination 104, permanently attached to an upper retention housing 200, and a given stock 101, permanently attached to a lower retention housing 300.

The two primary attachment points between the interrupted retention housing surfaces are as follows: the rear attachment elements 400 (FIG. 1), located in the rear of the interrupted elements in the position of the rear action screw port in the region to the rear of the trigger mechanism, and consisting of the tail-hook top and bottom components; and the forward attachment elements 500 (FIG. 1), consisting of the forward attachment port 250 of the upper retention housing 200 (FIG. 5) and the opposing forward attachment port 350 of the lower retention housing 300 (FIG. 11). Thus, as previously discussed, the forward attachment point, on the barrel side of the receiver/barrel interface is used for the forward attachment. The tail-hook components are used for the rear attachment and are addressed below. Thus, one attachment point is located on either end of the interrupted retention housing surfaces allowing for the remaining center portion of the receiver/barrel combination to be maintained without touching the said retention elements, an orientation that allows for the free-floating of the non-attached central portion of the receiver/barrel combination.

The said joints between the interrupted housing structures of the caliber exchange system 100, between the rear attachment elements 400 in the rear of the caliber exchange system 100 and between the forward attachment elements 500 in the front of the caliber exchange system 100, are designed to be selectively applied and removed. The selective attachment of the forward and rear attachment screws is central to the implementation of the caliber exchange system. The application and removal of the said selective attachment allows for the application of a given receiver/barrel combination to the stock. The said combination may be selectively removed in order to increase portability for transport in the embodiment of the take-down rifle, or the said combination may be selectively removed in order to apply a separate given receiver/barrel combination of a different caliber in the embodiment of the caliber exchange system.

The attachment points between the upper and lower retention housing structures are unique because the said front and rear attachment elements are disposed completely between the said upper and lower retention housings, positions which prohibit the direct contact between the receiver and stock; are positioned to provide for an increased distance to be created between the said attachment points, the said attachment point separation embodiment; and allow for the implementation of an attachment point on the barrel side of the recoil lug axis, an attachment that is positioned independent of direct contact with the barrel, a fact which insures floatation of the entire receiver/barrel combination. Thus, attachment point separation is created without direct contact with the barrel.

The upper and lower retention housing structures are to be manufactured in aluminum to decrease the weight of the system. The attachment surfaces in the front and rear will be reinforced with steel inserts that are to be counter-bored and pressed into the aluminum. The steel reinforcement serves to prolong the life of the given elements and to strengthen the platform to insure safe usage for the given life of the firearm.

Forward Attachment Site

The forward attachment elements 500 (FIG. 1) form a selectively removable joint that is fastened by the operator via the application of an external screw, and is the only articulation point that is to be mobilized during the operation of the caliber exchange system. The forward attachment elements 500 utilize the said principle of attachment point separation, with position of the said elements on the barrel side of the receiver/barrel interface. The forward attachment elements 500 create an end-to-end joint with flat opposing load bearing surfaces that contain matching opposing forward attachment ports articulated with a single articulation screw. The forward attachment elements 500 consists of the forward attachment port 250 on the upper retention housing 200 and the opposing forward attachment port 350 on the lower retention housing 300. As noted above, the forward attachment elements are combined in functionality with the recoil transfer extension elements, a configuration which presents two opposing flat surfaces together in an end-to-end configuration to create a load bearing surface that prevents recoil forces from acting on the attachment elements. The forward attachment site is the only screw point that will be utilized by the operator to attach a given receiver/barrel combination to the stock. A single forward attachment screw will be inserted through the inferior surface of the forward attachment port 350 on the lower retention housing, through the said port, and into the forward attachment port 250 on the upper retention housing. Externally applied force is required by the operator to seat the forward attachment screw firmly into the corresponding forward attachment screw ports. Thus, the embodiments of the invention implementing the caliber exchange and take-down rifle functionalities are made operable by the application and removal of a single screw located in the forward attachment site.

Rear Attachment Site—Tail-hook Components

The rear attachment elements 400 (FIG. 1) form a selectively removable joint located at the rear of the interrupted retention housing surfaces positioned in the rear action screw port location. Once constructed from its elements, the rear attachment site is a screw-less joint utilized to anchor the rear portion of the receiver/barrel combination to the rear portion of the stock. In the utilization of the caliber exchange system, the rear attachment site is articulated first to anchor the rear of the receiver/barrel combination. The precision fit of the screw-less joint directs the application of the remaining portion of the receiver/barrel combination onto the forward attachment site described above. Once seated, the geometry of the rear attachment site firmly holds the rear portion of the receiver/barrel combination in position. Thus, the tail-hook components create a rear attachment point via the application of a self-retaining, screw-less, ball and socket joint.

The rear attachment elements 400 consist of the following: the tail-hook top 280 (FIG. 5), the upper component attached directly to the receiver 102 in the position of the rear action screw port immediately posterior to the trigger port; and the tail-hook bottom 370 (FIG. 9), the lower component that utilizes a slotted fit articulation joint to firmly attach to the rear of the lower retention housing 300 in the position of the rear action screw port immediately posterior to the trigger housing, a region designated as rear inferior attachment point 360.

The tail-hook top 280 (FIG. 5) is the upper section of the rear attachment joint, and is permanently secured directly to the rear portion of the receiver 102 in the rear action screw position. The tail-hook top 280 is composed of the following elements as depicted in FIG. 8: the receiver securing port 283, located on the beveled superior surface of the tail-hook top and is utilized to permanently attach the tail-hook top to the receiver; the posterior male extension 281, the machined element that extends posteriorly from the tail-hook top and is utilized in the mating process between the rear attachment elements; the rotation bosses 282, round machined elements positioned on either side of the posterior male extension that are utilized to support the mating surface during the engagement of the rear attachment elements; and the retention seat (not pictured), a machined groove located on the inferior surface of the tail-hook top that serves to engage the forward strut of the tail-hook bottom component. The tail-hook top component is permanently attached to the receiver at the position of the rear action screw port via the application of a rear articulation screw.

The tail-hook bottom 370 (FIG. 9) is directly attached to the lower retention housing in the rear action screw port location, an articulation that utilizes a slotted port for secure articulation. The attachment of the tail-hook bottom 370 to the lower retention housing 300 is accomplished via the permanent positioning of the inferior surface of the tail-hook bottom 370 within the machined port in the location 360 in the rear of the lower retention housing. A single articulation screw is utilized to permanently secure the tail-hook bottom to the lower retention housing.

The elements of the tail-hook bottom 370 as depicted in FIG. 12 are as follows: the inferior slotted articulation joint 371, a surface that is machined to geometrically fit within the rear action slotted port 360 of the lower retention housing 300; the female insertion port 372, a machined port along the center-line of the tail-hook bottom that articulates with the posterior male extension of the tail-hook top; boss support rings 373, bilateral grooves on either side of the female insertion port that house the rotation bosses of the tail-hook top during mating; stop arch 374, the superior surface of the tail-hook bottom component formed from the joining of the boss support rings that serves to halt the rotation of the posterior male extension and prevents lateral and horizontal movement of the receiver after articulation; and the forward strut 375, a superior extension of tail-hook bottom 370 located anterior to the female insertion port 372, positioned immediately posterior to the trigger housing 310 of the lower retention housing 300, serves to guide the receiver/barrel combination on its anterior movement towards the mating surfaces of the forward attachment site, and firmly seats the anterior portion of the tail-hook top 280 within the tail-hook bottom 370. The tail-hook bottom 370 is permanently attached to the rear of the lower retention housing 300 by a single rear articulation screw.

The assembly of the rear attachment elements 400 is discussed below. The tail-hook top 280 is permanently attached directly to the rear of the receiver 102 utilizing the rear action screw port. The tail-hook bottom 370 is permanently attached directly to the rear of the lower retention housing 300. The inferior slotted articulation joint 371 is utilized to firmly bed the tail-hook bottom 370 within the rear inferior attachment point 360 of the lower retention housing 300. The said slotted fit of the joint serves to prevent recoil forces from shearing the said attachment surface between the tail-hook bottom 370 and the lower retention housing 300. Both the tail-hook top and the tail-hook bottom may be constructed of steel. The steel material allows for a stronger resistance to wear at the articulating surfaces, a fact which will prolong the life of the said components of the caliber exchange system 100. The screw articulations at the permanent attachment points between the tail-hook top and the receiver and between the tail-hook bottom and the lower retention housing may be augmented in function by the application of anaerobic glue or loctite.

The mating of the rear attachment site components is discussed below. The rear of the receiver/barrel combination is positioned superior to the stock with the rear of the receiver tilted toward the posterior edge of the lower retention housing, a relationship in which the long axis of the receiver/barrel combination will be on a plane forty-five degrees superior to the long axis of the stock. The posterior male extension element 281 of the tail-hook top 280 is guided by the operator into the female insertion port 372 of the tail-hook bottom 370. The rear end of the receiver is guided to a location between the stop arch 374 and the forward strut 375 of the tail-hook bottom 370. The posterior male extension element 281 slides through the female insertion port 372 until the rotation bosses 282 of the tail-hook top contact the opposing boss support rings 373 of the tail-hook bottom. The opposite end of the receiver/barrel combination is then tilted forward by the operator so that the tip of the barrel is brought down toward the stock. The posterior male extension element 281 is to remain within the female insertion port 372 and the contact between the rotation bosses 282 and their corresponding boss support rings 373 must be maintained in a constant fashion by the operator with a smooth forward sliding/rotational movement of the receiver/barrel combination. At the maximal point of rotation, the forward attachment site elements will contact, and the long axis of the receiver/barrel combination will be within the exact plane as the long axis of the stock. At the same time, the stop arch 374 of the tail-hook bottom will prevent further superior movement of the posterior male extension 281 within the female insertion port 372. The forward strut 375 will rest against the anterior surface of the tail-hook top. The rear portion of the receiver is held with exact precision by preventing lateral and horizontal movement of the tail-hook top within the tail-hook bottom by the sides of the female insertion port 372, the stop arch 374, and the forward strut 375. Thus, the rear of the receiver is prevented from movement in three directions. The forward attachment site elements are then firmly secured by the externally applied forward attachment screw. The said process is reversed in order to disarticulate the receiver/barrel combination from the stock.

Caliber Exchange Functionality/Key Elements/Sighting Mechanism

The inventive principle of the caliber exchange system allow for a given receiver/barrel combination to be mated to a given upper retention housing. The stabilization of the receiver/barrel interface, along with the maintenance of the receiver and barrel with each caliber exchange, allow for increased accuracy to be achieved by the system. The critical components of the rifle, the said receiver, barrel, and sighting mechanism, are allowed to be maintained throughout the separation of the receiver/barrel combination from the stock.

The traditional sighting mechanism on a firearm is either a scope or an open sight. Both sighting mechanisms are directly attached to the upper surface of a given receiver/barrel combination by separately machined ports in the said receiver or barrel. When one caliber group is exchanged for another, the sighting mechanism is not separated from the receiver/barrel combination. This unique attribute of the caliber exchange system allows for a scope or other mechanism to retain its zero throughout the selective separation of one caliber group from the platform and the addition of another said caliber group. Thus, throughout the application of the caliber exchange system, no adjustments will need to be made on the point of aim held by the sighting mechanism, as the key components are maintained with the selective separation of a given receiver/barrel caliber combination.

The recoil lug axis may additionally be used to stabilize the sighting mechanism. The front and rear scope mounts are traditionally directly attached to the superior surface of a given receiver. The scope mounts may be machined in multiple components or in a single element. In the application of the caliber exchange system, a superior extension of the recoil lug may be used as an attachment point for the forward element of the given scope mount configuration. A screw attachment is operable to permanently join the interface between the forward element of a given scope mount configuration and the recoil lug. The securing of the scope mount to the receiver/barrel combination at the recoil lug axis further stabilizes the system and increases the accuracy. An additional embodiment of the sighting mechanism stabilization is to utilize rings around the receiver to directly attach the scope mounts to the upper retention housing. On ring is utilized for the rear base and another ring is utilized for the front base. The usual ports drilled and tapped into the receiver are additionally used. The result of either configuration is the stabilization of the scope throughout a long duration of usage with a firearm of a heavy caliber.

Maintaining the sighting mechanism with the receiver/barrel combination is a benefit of the caliber exchange system over a barrel switch or barrel separation modality of takedown rifle, as the receiver/barrel combination will only needed to be sighted in or zeroed once prior to the application of the selected removal of the given receiver/barrel combination from the stock. When a given receiver/barrel combination is selectively removed and then replaced onto the platform, the aiming point of the sighting mechanism has not changed due to the fact that the key elements of the rifle, the receiver, barrel, and sighting mechanism, have been physically maintained throughout the said process of selective separation.

CES: Shepherd Configuration Concept

The caliber exchanging system is embodied by the principle that the core components of a rifle are bedded to a given surface, and the said given surface is then bedded within the stock 101. In the said relationship, the core components of a rifle may be separated from the bedding surface of a given stock 101, with the maintaining of the inherent relationship between the said core components of a rifle. The caliber exchanging system may be utilized as a segmentation system in which the two said bedding surfaces are separated, a configuration in which the stock is not segmented and the core components are maintained.

A further embodiment of the caliber exchange system is described below in which pillars are utilized as the surfaces within which the components of the said caliber exchange system will mate.

Recoil Lug Screw: concept

Figure 16:
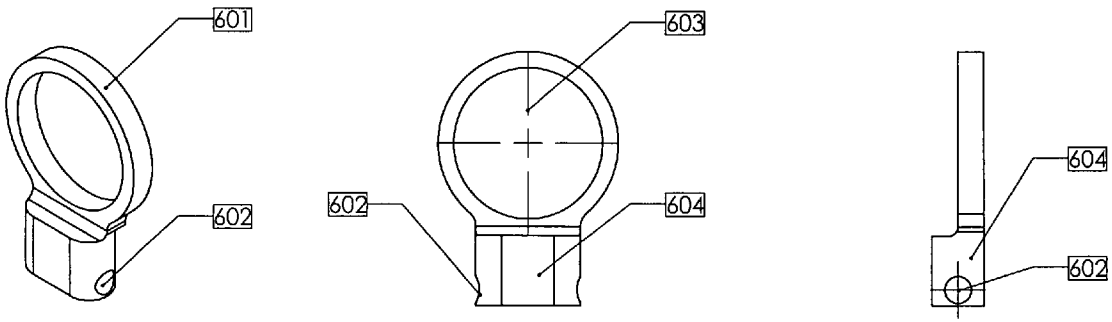
FIG. 16 is a diagram of the recoil lug utilized in the shepherd configuration.

The recoil lug screw and recoil lug screw port are presented as a concept in the following discussion and are depicted in FIG. 16. The inventive principles of the caliber exchange system 100 incorporate the unique adaptation of a recoil lug. The recoil lug 601 (FIG. 16) is machined with a side port 602 to allow for the placement of a separate articulation screw to more firmly seat the recoil lug within the interrupted bedding surface. As described above, the inventive principles of the caliber exchange system 100 utilize the traditional location of the recoil lug to stabilize the receiver/barrel interface to the upper moiety of the interrupted bedding surface, and not as the traditional usage of recruiting the said recoil lug into a bedding system that directly attaches the recoil lug itself to the stock. The separation of the functions of the traditional recoil lug from the functions of the recoil lug as utilized in the caliber exchange system 100, allow for an extended surface to be created between the receiver/barrel combination and the stock. The said unique arrangement then allows for the full floatation of the receiver/barrel combination within the stock.

In a standard rifle produced by any given manufacturer, a forward recoil lug is used to secure the interface between the mating of the barrel and the receiver. The recoil lug is a separate machined ring is utilized at the barrel/action interface to attach the barreled action to the stock. The purpose of the recoil lug is to reduce the strain that must be withstood by the forward and rearward action screws during recoil. Many types of recoil lugs are utilized including but not limited to lugs that are incorporated into the barrel or the receiver. The recoil lug has an extension that extends inferiorly from the receiver/barrel interface. The extension is seated within a recessed portion of the fore-end of the stock. In the prior art, the recoil lug serves as a support extension, merely to support the firearm within the stock during recoil, and does not include a port for the explicit insertion of a screw. In the prior art, bedding chassis systems have been implemented to further enhance the articulation between the said recoil lug and a given bedding system. External support is provided for the recoil lug along a given face of the recoil lug extension, but the additional support is applied to a face of the external extension, a configuration which does not utilize an additional articulation screw through the recoil lug extension itself. Further, the chassis systems are designed to attach the recoil lug to the stock itself, a configuration in which the traditional recoil lug itself is utilized to bed a receiver directly to a stock.

A separate screw or bolt may be utilized in the connection of the recoil lug at the barrel/action interface, but the said screw or bolt is not used in a function to actually support the interface during recoil. In the prior art, the inferior extension of the recoil lug is the only interface that supports the firearm during recoil, and its operation does not include the application of a screw or bolt for the said purpose of supporting the firearm during recoil. In the present embodiment, a port is utilized in the forward portion of the transition plate that is oriented parallel to the long axis of the fore-end section of the stock, or the long axis of the barreled action. The port is a separate machined component that allows for the application of a screw or bolt, in a plane perpendicular to the long axis of the barreled action. The screw or bolt serves to anchor the recoil lug extension surface within the transition component. In short, the recoil lug extension is anchored within the recoil lug recess by the application of a screw or bolt into the said recoil lug attachment port.

In the prior art, utilization of a recoil lug attachment port is prohibited by the inherent structure of the stock, in that the possible application of an additional port is prohibited by the surrounding adjacent portions of the stock. Due to this restriction, the prior art utilizes a recess within the stock in which the recoil lug extension is placed, and is prohibited from the utilization of an additional screw by the said configuration. With the intended removal of the receiver/barrel combination from the stock, the location of the barrel/action interface is left available for the application of an additional port, the recoil lug attachment port. The interface is available because the additional component serves as the bedding for the core components of the rifle and the stock itself. Thus, the spatial restrictions placed on the systems utilizing the prior art, a relationship in which the stock serves as the support for the core components of the rifle and provides a space for the seating of the recoil lug, are removed with the invention of the interrupted bedding surfaces. This concept is new in that implementation of the likeness of a interrupted bedding surface allows the utilization of a screw or bolt into the said recoil lug attachment port for the purpose of supporting the said barrel/action interface during recoil; and the screw or bolt is inserted in a plane that is perpendicular to the long axis of the barreled action for maximal support during recoil.

Shepherd Configuration

The shepherd configuration of the segmentation system utilizes a segmentation in which the said core or critical components of the rifle are articulated with an upper receiver portion and are then mated with the bedding surface. The shepherd configuration allows for the core components of a rifle to be separated from the stock itself, a fact which allows the creation of a take-down rifle with interchangeable calibers. The pillar positions are transformed into a unique pillar-bushing configuration to utilize the traditional pillar bedding modality as a point of segmentation in the creation of a take-down rifle. The usage of pillar bedding and not full length glass bedding allows for an increased surface to be created for the floating of the receiver/barrel combination within the stock.

Figure 14:
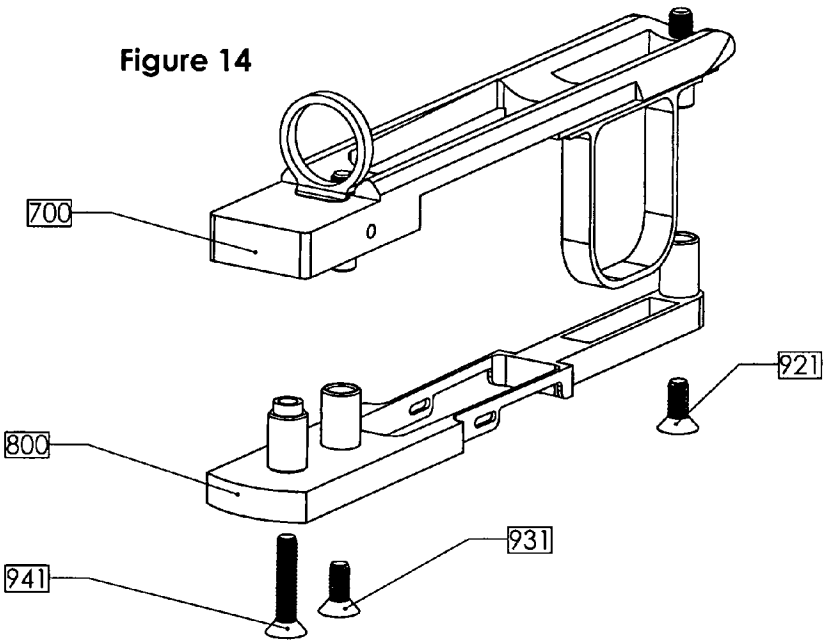
FIG. 14 is a diagram of the two major components of the shepherd configuration.
Figure 13:
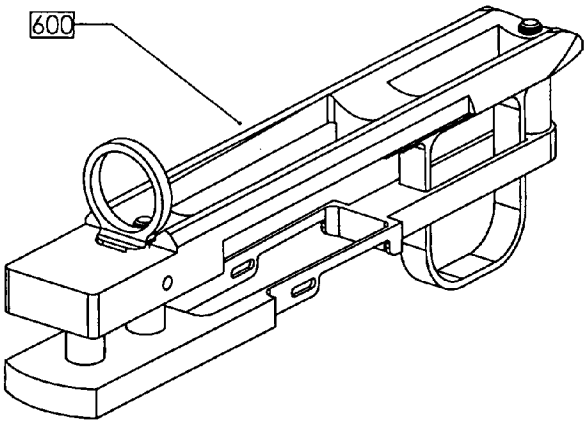
FIG. 13 is a diagram of the shepherd configuration of the segmentation system.

The shepherd configuration 600 of the caliber exchange system 100 is depicted fully assembled in FIG. 13. The major assembled components of the shepherd configuration are depicted in FIG. 14 and consist of an upper receiver assembly 700 and a lower bedding assembly 800. The upper receiver assembly 700 is firmly bedded to the said receiver/barrel combination. The lower bedding assembly 800 is bedded within the said stock and provides the surface to which the upper receiver assembly 700/receiver/barrel combination will be mated to the lower bedding assembly 800. Thus, the implementation of the shepherd configuration 600 allows for the creation of a caliber exchanging system by the separation of the critical components of the rifle from the bedding surface.

Shepherd Configuration: Concept of Caliber Exchanging System

In the shepherd configuration 600, depicted in FIG. 13, the bedding surface is constant within the rifle stock 101. The implementation of the shepherd configuration 600 allows the creation of a caliber exchanging system according to the embodiments of the concepts detailed above in the caliber exchange system 100. The principles of the caliber exchange system 100 are constant in the embodiment of the shepherd configuration 600 in that the said action, barrel, trigger mechanism, trigger guard, and scope mounts are allowed to be maintained in continuity with the implementation of the caliber exchange system components. The shepherd configuration 600 allows for the said core components of the rifle to be exchanged for another assembled group of core critical components (the said caliber to be exchanged) without affecting the accuracy in the usage of the said critical components. The shepherd configuration 600 utilizes the said front and rear action screw ports for the implementation of the said exchanging of calibers. In the shepherd configuration 600, the front and rear action screw ports are utilized for the implementation of the likeness of a pillar, and the said pillars are utilized to create the said caliber exchanging system, according to the principles of the said caliber exchanging system described above. In the shepherd configuration 600, the upper receiver assembly 700 and lower bedding assembly 800 are utilized as interrupted bedding surfaces.

Shepherd Configuration: Components

Figure 15:
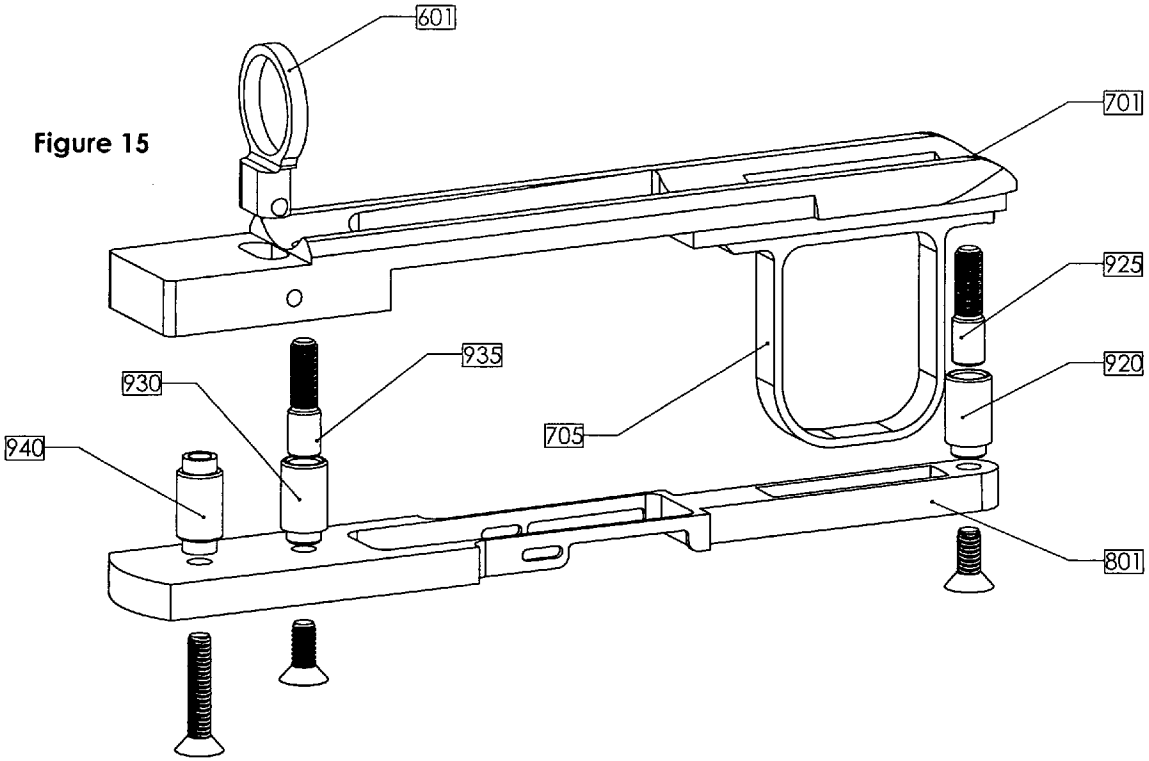
FIG. 15 is s diagram of an exploded view of the shepherd configuration.

The upper receiver assembly 700 of FIG. 14 is addressed below. The upper receiver assembly 700 components are depicted in FIG. 15 and consist of the upper plate 700, the trigger guard 705, and the recoil lug 601.

The upper plate 701 is depicted in FIG. 16 and consists of the rear action screw port 710, front action screw port 720, trigger mechanism receiving port 730, magazine port 740, recoil lug receiving port 750, recoil lug screw attachment port 755, and the forward attachment port 760. The trigger guard 705 (FIG. 15) is attached to the inferior surface of the upper plate 701 by the utilization of the rear action screw port 710 and additional forward trigger guard attachment port (not pictured). The rear action screw port 710 accepts the rear action screw for the articulation of the barreled action to the upper plate 701. The front action screw port 720 accepts the forward action screw for the articulation of the barreled action to the upper plate 701. The trigger mechanism receiving port 730 is the port that accepts the likeness of the trigger mechanism as it is inserted through the trigger mechanism receiving port 730 during the articulation of the upper plate 701 with the barreled action. The magazine port 740 is the port that allows for the acceptance of the likeness of the magazine. The forward attachment port 760 is utilized as one of the attachment surfaces of the pillar bushing components described below.

Figure 17:
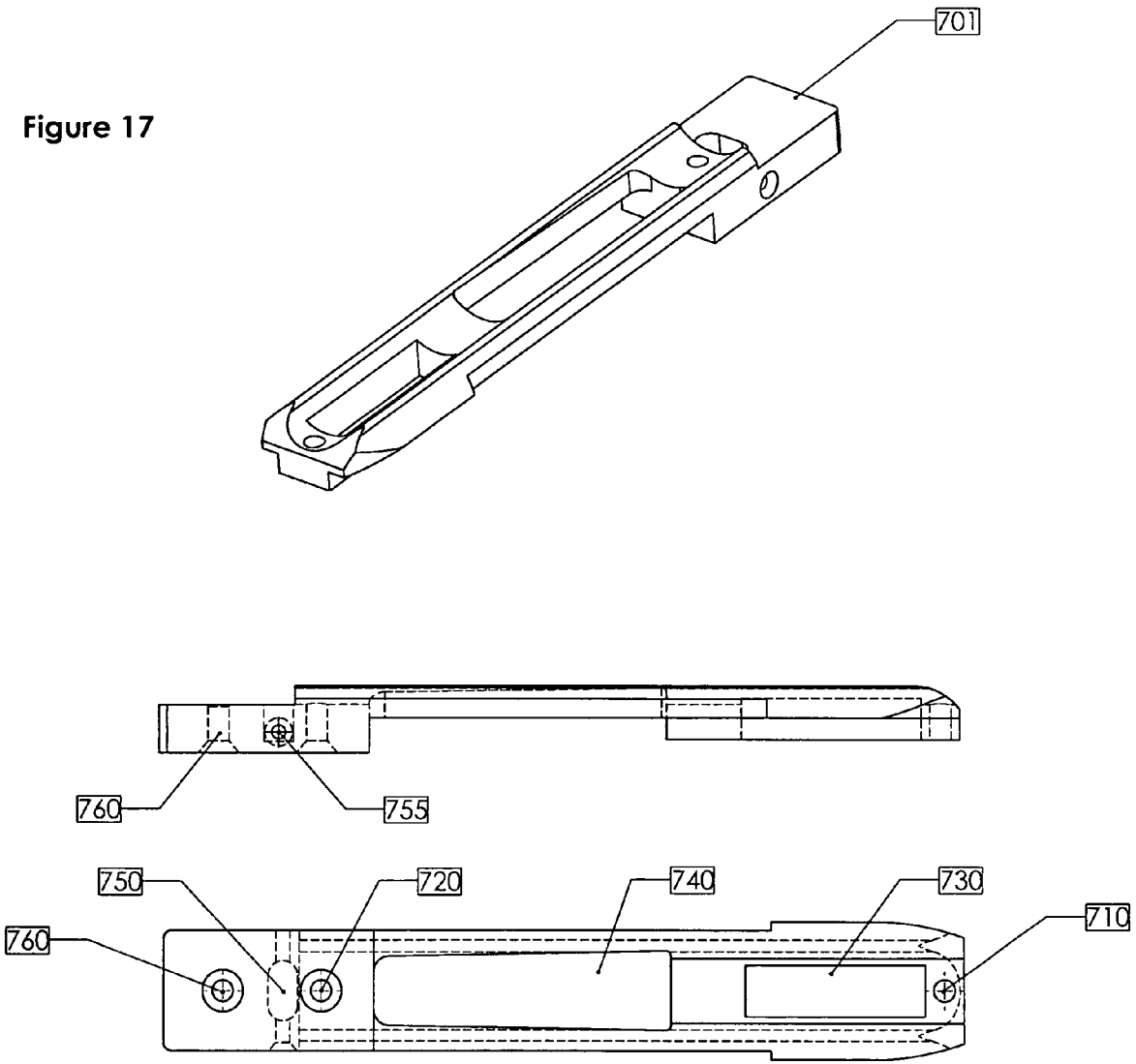
FIG. 17 is a diagram of the upper plate of the shepherd configuration.

The recoil lug 601 (FIG. 16) consists of the action/barrel assembly port 603, the inferior extension surface 604, and the recoil lug articulation screw port 602. The recoil lug is articulated with the recoil lug receiving port 750 in the upper plate 701 (FIG. 17). The recoil lug inferior extension surface 604 is seated within the said recoil lug receiving port 750 and the recoil lug articulation screw (not pictured) is inserted into the recoil lug screw attachment port 755 of the upper plate 701 and into the recoil lug articulation screw port 602, a function which allows a firm seating of the recoil lug within the upper plate 700. As described in the said embodiments above, the recoil lug provides support for the receiver/barrel interface, a relationship that provides additional support and thus increases accuracy. In following with the previous embodiment, the recoil lug includes a screw port that allows for further increased support between the barreled action and the upper bedding moiety. The said recoil lug screw port 602 is positioned to allow for the articulation of the recoil lug attachment screw along a plane that is perpendicular to the long axis of the barreled action and the upper plate.

Figure 18:
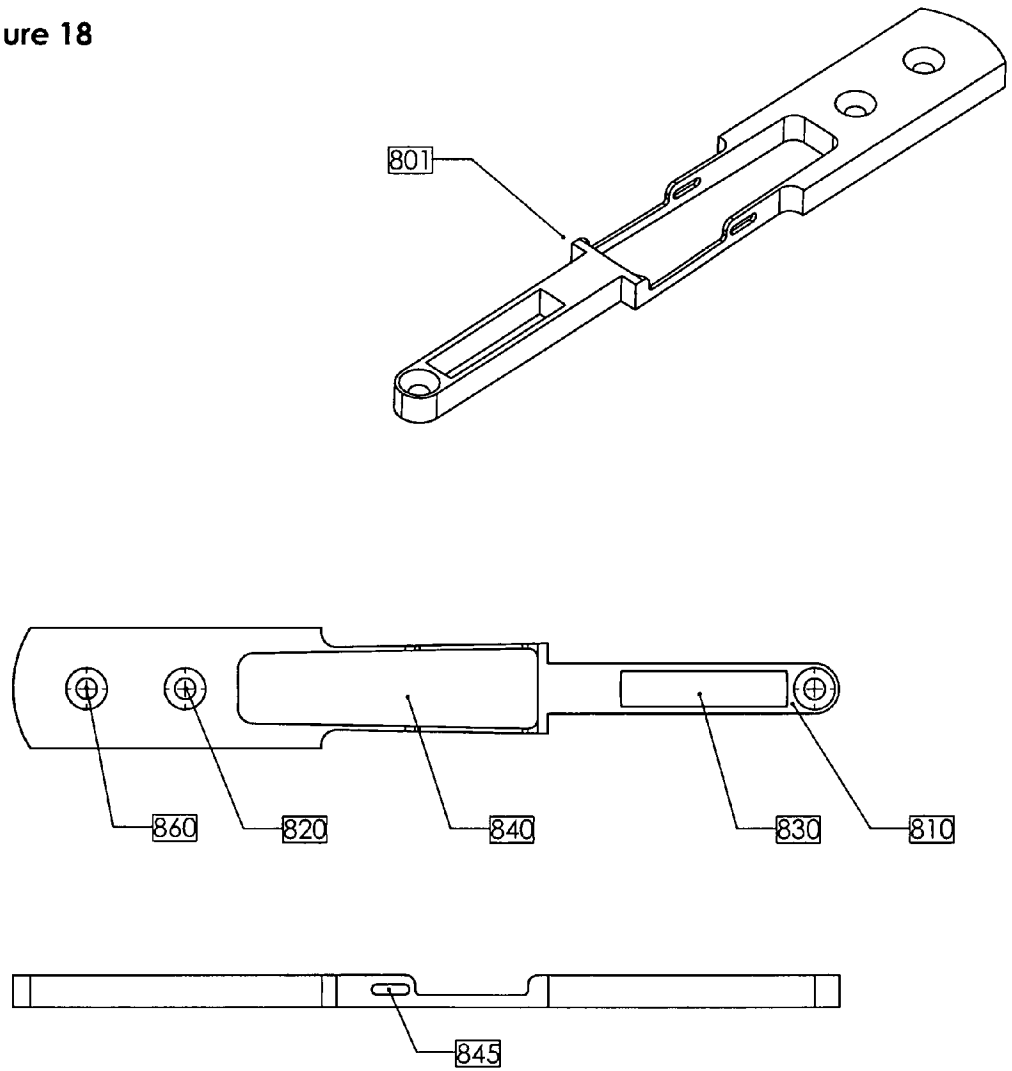
FIG. 18 is a diagram of the lower plate of the shepherd configuration.

The lower bedding assembly 800 (FIG. 14) is depicted in detail in FIG. 18. The lower bedding assembly 800 is formed primarily from the lower plate 801. The lower plate 801 is firmly bedded within stock 101 with the said bedding compounds. The lower plate 801 is depicted in FIG. 18 and consists of the rear action screw port 810, the front action screw port 820, the trigger guard receiving port 830, the magazine insertion port 840, the magazine attachment surface 845, and the forward attachment port 860. The lower plate 801 provides the bedding surface to which the pillar bushings (described below) and the upper plate/barreled action are mated. The magazine insertion port 840 and the magazine attachment surface 845 may be machined to fit a floor plate with a non-removable magazine. The shepherd configuration 600 is depicted utilizing a removable magazine but is not limited to the said configuration, with the application of the embodiments described above. The likeness of the magazine is inserted from the inferior surface of the stock through the magazine insertion port 840 and is attached to the magazine attachment surface 845. The likeness of the magazine is advanced through the magazine port 740 of the upper plate 701 and rests in position such that the contents of the said magazine may be fed into the action for firing. The forward attachment port 860 is utilized as one of the attachment surfaces of the pillar bushing components described below.

The central pillar bushing components are depicted in FIG. 15. The central pillar bushing components consist of the rear action pillar 920, the rear action bushing 925, the front action pillar 930, the front action bushing 935, and the forward support pillar 940. The pillars are bedded firmly in the stock with the application of the said bedding process utilizing the said bedding compounds. The said bedded pillars, embodied in FIG. 15, are supported by the said bedded lower plate 801. The rear action bushing 925 and the front action bushing 935 are attached to the upper plate 701 and utilize the said front and rear action screw ports in the said upper plate. The front and rear action bushings utilize the position of the front and rear action screw ports in the stock 101 and are used to attach the barreled action to the said upper plate. The said attachment of the action bushings to the receiver are permanent bonds, and the attachment may be augmented by anaerobic glue or locktight.

The front and rear action pillars are depicted in FIG. 15. The rear action pillar 920 utilizes the position of the rear action screw port of stock 101, and is supported by the rear action screw port 810 of the lower plate 801. The front action pillar 930 utilizes the position of the front action screw port of stock 101, and is supported by the front action screw port 820 of the lower plate 801. The said rear and forward action pillars are firmly bedded within the said action screw ports of the stock and are supported by the said action screw ports of the lower plate 801. Thus, the likeness of a pillar is utilized in the position of the rear and front action screw ports in the shepherd configuration 600.

The forward support pillar 940, depicted in FIG. 15, is located on the barrel side of the recoil lug axis. The forward support pillar 940 creates a pillar supporting surface forward of the recoil lug axis. With the implementation of the front action pillar 930, located on the receiver side of the recoil lug axis, and the forward support pillar 940, located on the barrel side of the recoil lug axis, the recoil lug axis is firmly supported. The implementation of the said dual support of the recoil lug axis creates a firm support system for the bedding of the barreled action. The forward support pillar 940 is bedded in a fashion analogous to the said bedding of the front and rear action pillars. Thus, the forward support pillar 940 is utilized in a position forward of the recoil lug and may be implemented as an additional bushing port with the application of the caliber exchanging system when a caliber with a large amount of recoil is used.

The prior art utilizes pillars in the front and rear action screw ports of the stock, but the prior art does not utilize the said positions for the creation of a caliber exchanging system. In addition, a third pillar located in the position of the forward support pillar 940, forward of the recoil lug axis, is a new identity and is not included in the prior art. The forward support pillar 940 may be utilized as a bushing port (described below) in the implementation of the caliber exchanging system in which a caliber of large recoil is utilized as the said caliber to be exchanged. Thus, the prior art does not use pillars in a detachable fashion, as the pillars are designed in the prior art to serve only as support surfaces to reinforce the rear and forward action screw ports of a given stock. As described above, the purpose of the pillar in the prior art is to allow for the screws articulated into the front and rear action screw ports of a given stock to be tightened without affecting the bedding of a barreled action. With the said securing and tightening of the rear and front action screws in the prior art, the pillar supports the said rear and front action screw ports, not allowing the said action screw ports to be compressed with the force of securing the barreled action to the bedding surface. The implementation of the three pillar support components is not included in the prior art, both as a mechanism to create a caliber exchanging system, in which the pillars are used to accept bushings for the implementation and removal of multiple calibers, and as the implementation of a pillar forward of the recoil lug axis for the additional support of the said recoil lug axis. Thus, the segmentation system utilizing the three central support pillars is new according to the inventive principles described above.

The bushing components of the central pillar bushing components are depicted in FIG. 15. The bushings consist of rear action bushing 925 and the front action bushing 935. The rear action bushing 925 is located in the position of the rear action screw port of the stock 101, and is articulated with the rear action screw port 710 of the upper plate 701 for the purpose of mating the barreled action with the upper plate 701. The front action bushing 935 is located in the position of the front action screw port of the stock 101, and is articulated with the front action screw port 720 of the upper plate 701 for the purpose of mating the barreled action with the upper plate 701. Thus, the said rear and front action bushings are utilized to articulate the barreled action with the said upper plate; the said articulation is via the application of the said bushings in the location of the rear and front action screw ports of stock 101.

The caliber exchanging system is created by the implementation of the front and rear action bushings and the three pillar components, utilizing the said positions of the front and rear action screw ports of rifle stock 101. The rear action bushing 925, attaching the rear portion of the barreled action to the upper plate 701 via articulation through the said port 710, mates with the rear action pillar 920. The front action bushing 935, attaching the front portion of the barreled action to the upper plate 701 via articulation through the said port 720, mates with the front action pillar 930. As depicted in FIG. 14, two separate articulation screws are utilized to attach the upper plate/barreled action to the lower plate/stock section. The primary attachment screws connecting the interrupted support structures are the rear action screw 921 and the front action screw 931. The rear action screw 921 is inserted through rear action screw port 810 of the lower plate 801 into the rear action pillar 920, an attachment performed to firmly secure the rear action bushing 925 into the rear action pillar 920. The front action screw 931 is inserted through front action screw port 820 of the lower plate 801 into the front action pillar 930, an attachment performed to firmly secure the front action bushing 935 into the front action pillar 930.

According to the principles defined by the mating of the segmentation system components above, the bushing fits within the pillar by a geometry determined by the configuration of the two components to be attached. The said bushing is articulated within the corresponding said pillar, and the said inferior articulating screws are advanced, from inferiorly to a position otherwise superiorly, through the pillars and into the corresponding said bushing, the bushing having mated with the corresponding pillar. Thus, the said bushings are firmly secured within the corresponding pillars after mating by the application of the said inferior articulation screws, the said mating occurs in the location of the front and rear action screw ports of rifle stock 101. The caliber exchanging system is created by the articulation with the said bushings with the corresponding said pillars. The said front and rear action screws are then disengaged in order to form a take-down rifle.

As described above, the forward support pillar 940 may be utilized as an action pillar for increased support from the recoil of a large caliber utilized in the caliber exchanging system. The inferior articulation screw 941 (FIG. 14) is inserted into the said port 860 of the lower plate 801 and into the forward support pillar 940. The said port 760 (FIG. 17) of the upper plate 701 may be utilized to accept a forward support bushing (not pictured). The forward support bushing would mate with the forward support pillar 940, analogous to the said mating of the components above.

The shepherd configuration 600 is depicted with the said rear and front action screw ports utilized as the attachment points between the upper and lower plates. The said configuration is not limited to the said rear and front action screw port positions. In an extension of the embodiment, the rear action screw port and the forward support pillar locations may be utilized as the two primary attachment positions. In this configuration, the distance between the two bushing/pillar attachments is widened and would create a more stable bedding surface; the said forward action screw port location would be utilized as a support pillar position.

Caliber Exchange System Summary

The inventive principles of the caliber exchange system overcome the limitations of current bedding techniques to create a stable and precise selective mating configuration between a given receiver/barrel combination and a separate uniform platform. The selective separation of a receiver/barrel combination from the platform allow for the inventive principles of the caliber exchange system to function as a take-down rifle, a configuration in which the two said selectively separated bodies may be transported with increased portability. With the consistency created from the precision of the attachment surfaces and the elegant operation of the selective separation, the single platform may be utilized to service multiple receiver/barrel combinations of a plurality of calibers. The caliber exchange system utilizes a single attachment screw that must be independently operated to implement the said selective attachment, a configuration which is an improvement on some of the cumbersome attempts in the prior art. The ease of operation and implementation of the caliber exchange system provides for rapid, reliable, and repeatable deployment in the field under any conditions.

Conservation of the physical construct of the receiver, barrel, and sighting mechanism throughout the utilization of the caliber exchange and take-down rifle functions allows for the platform to maintain accuracy and avoid point of impact changes during the selective removal and application of a plurality of receiver/barrel combination caliber groups. The implementation of the inventive principles of the caliber exchange system in the creation a take-down rifle by utilizing the bedding system as the segmentation location is unique and prevents separation of the critical components of the rifle, a configuration which is an improvement over the take-down systems in which the receiver and barrel are separated or the barrel is switched.

The bedding systems in the prior art are narrowed in focus due to the acceptance of the constraints inherent in a given receiver, with respect to available ports for attachment, and acceptance of the constraints of a stock visualized as a single structure containing attachment points that mirror a given receiver used peculiarly to firmly secure the said receiver to a given mating stock. The vast majority of bedding configurations in the prior art utilize, in variable contributions, the rear action screw, the front action screw, and the recoil lug, in the creation of a full length bedding of the receiver. The focus of the current bedding systems is narrowed due to the persistent dependence of the said attachment points on the receiver and the opposing mirrored surfaces on the stock. The concept is further narrowed by the concept that a single stock should be only utilized by a single receiver/barrel combination.

The direct, intended removal of the receiver/barrel combination from the stock expands upon the limitations of the current bedding techniques by allowing for the entire undersurface of the said receiver/barrel combination to be utilized as a bedding surface. By physically extending the surface underneath the receiver anteriorly to a point located on the barrel side of the recoil lug axis, the bedding surface available for usage is increased. The positioning of a separate, mechanical forward attachment point on the barrel side of the receiver/barrel interface allows for an increased distance to be created between the attachment points utilized in the mating of a given receiver/barrel combination to a stock. The attachment point separation, or the said increased distance created by the utilization of an independent screw point on the barrel side of the receiver/barrel interface, is operable to form a more stable platform for the mounting of a receiver/barrel combination to a given stock, an arrangement which allows for the floatation of the remaining free portions of the said receiver/barrel combination, a function which improves upon a prior limitation realized in all bedding practices understood in the prior art.

The caliber exchange system utilizes the inventive principles of an interrupted retention housing and a specific attachment point configuration to allow for the selective separation of a receiver/barrel combination of a given caliber from a given stock. Selective attachment/separation is defined as the intended separation of the receiver/barrel combination from the stock and then the replacement of the said receiver/barrel combination depending on the demands of the operator, a relationship that requires independent operation by a user in order to purposefully separate the firearm platform into two major components for the creation of a take-down rifle. Replacement of a given receiver/barrel combination of a given caliber for an additional independent receiver/barrel combination of an additional independent given caliber allows for the implementation of the inventive principles of the present invention in the caliber exchange function.

The implementation of the unique interrupted support surface allows for a given receiver/barrel combination to be mated to a stock with a high degree of precision, such tolerances allow for a consistent surface to be created between a plurality of receiver/barrel combinations with a single platform. The interrupted configuration, in which an upper moiety is utilized to stabilize the receiver/barrel interface and provide for the means of attachment point separation and a lower moiety is utilized as a solid, stable platform within the stock, allows for the implementation of the caliber exchange and take-down rifle functions.

Three separate permanent articulation points between the upper retention housing and the receiver/barrel combination firmly bond the two said components, a bond which stabilizes the receiver/barrel interface by increasing the stiffness of the system at the said junction of the receiver and barrel. With the inventive principles of a separate articulation screw port and independent screw, a unique recoil lug is utilized in the stabilization of the receiver/barrel interface, a function separate of the understood recoil lug functionality as held within the prior art. The upper retention housing positions a separate articulating port on the barrel side of the receiver/barrel interface for utilization in the mating between the interrupted retention housings.

The lower retention housing allows for a stable platform to be created for the application of a plurality of receiver/barrel combinations. The uniform base, with attachment points at either end, creates a precise and repeatable surface for the consistent presentation of the trigger mechanism into the receiver, a configuration which overcomes previous limitations of the positioning of the trigger mechanism. The uniform base also overcomes the limitations of previous bedding systems in which the material utilized in the construction of the stock affects the receiver/stock relationship. In the embodiment of the caliber exchange system, the stock material chosen by the operator does not affect the inherent function of the system, as the attachment points are upper housing to lower housing, without the involvement of the stock material itself. Bonding of components to the major surfaces may utilize any of the liquid epoxy materials inherent in the usage of current bedding techniques. The multiple permanent attachment points secured with a separate articulating screw may be strengthened from the application of anaerobic glue or loctite. The said permanent attachment points may be mobilized for the maintenance or replacement of any of the system components, including but not limited to the receiver/barrel combination, upper retention housing, articulation screws, the front and rear attachment elements, and the lower retention housing.

The inventive principles of the caliber exchange system include the configurations and locations of the attachment points between the upper and lower retention surfaces. The unique embodiment of attachment point separation allows for the floatation of the entire receiver/barrel combination and the utilization of two exact points for the selective attachment between the receiver/barrel combination and the stock. The embodiments of the attachment point elements are central to the implementation of the caliber exchange system, as the mating must be precise to allow for predictable and repeatable results. One embodiment utilizes a tail-hook configuration in the rear and a single screw attachment in the front to perform the said selective attachment function. Another embodiment utilizes a pillar-bushing system to anchor the attachment points between the upper and lower retention housing surfaces.

The caliber exchange system allows for a given receiver/barrel combination of a given caliber to be selectively replaced by an additional receiver/barrel combination of a different given caliber. Selective separation of the interrupted support surface is to allow for the platform to be selectively separated at the interface between the support surfaces, a relationship which allows for increased portability of the two active portions, and thus serving the function of a take-down rifle. The support surfaces are selectively separated in an exact configuration to allow for the critical components of the rifle, defined as the receiver, barrel, and sighting mechanism, to remain permanently joined throughout the operation of the caliber exchange system. Lastly, the mechanisms embodied by the attachment points in the present invention allow for an elegant attachment configuration that is streamlined to be operable by the external manipulation of a single screw.

The unique embodiments of the attachment point separation, the interrupted support surface, attachment point mechanism are fundamental in the implementation of the caliber exchange system and allow for the operation of the caliber exchange and take-down rifle functions.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed:

1. A take down system for a firearm comprising:

a lower plate adapted for embedding within a firearm stock;

an upper plate adapted to mate with the lower plate; and a receiver and integral barrel assembly attached to the upper plate to form a unit, the unit attachable and detachable from the lower plate to allow user take down of the firearm into a first portion comprising the unit and a second portion comprising the lower plate and the firearm stock, wherein the upper plate and the lower plate attach through a forward attachment port disposed forward of a front action screw port on the firearm stock when the lower plate is embedded within the firearm stock and the upper and lower plates are mated, and further wherein the upper plate includes a recoil extension at a first end of the upper plate and extending downward from a longitudinal axis of the upper plate; and the lower plate includes a recoil extension receptacle for receiving the recoil extension of the upper plate such that a majority of the unit floats above the lower plate.

2. The take down system of claim 1, further comprising a trigger mechanism attached to the lower plate, the trigger mechanism interfacing with the receiver when the unit attaches to the lower plate and disengages from the receiver when the unit detaches from the lower plate.

3. The take down system of claim 1, wherein the unit is a selected one of a set of like units of differing calibers.

4. The take down system of claim 1, wherein the upper plate comprises:

a plurality of spaced apart screw ports for attaching the upper plate with the receiver and integral barrel assembly; and recoil lug port for receiving a recoil lug associated with the receiver such that such recoil lug is spaced from the lower plate when the unit is attached to the lower plate, wherein the recoil lug port of the upper plate is disposed between the front action screw port and the forward attachment port on the firearm stock when the lower plate is embedded on the firearm stock and the upper and lower plates are mated.

5. The take down system of claim 2, wherein the lower plate further comprises a housing for the trigger mechanism, the trigger mechanism engaging with the receiver when the unit is attached to the lower plate and the housing and the trigger mechanism separating from the receiver when the unit is detached from the lower plate.

6. The take down system of claim 1, further comprising a tail hook top fastened to the receiver of the unit and a tail hook bottom attached to the lower plate, the tail hook top and tail hook bottom engaging when the unit is attached to the lower plate.

7. The take down system of claim 4, wherein the plurality of spaced apart screw ports for attaching the upper plate with the receiver includes a forward attachment screw port disposed forward of the recoil lug port.

8. A caliber exchange system for a rifle comprising:

a receiver and integral barrel assembly of a selected caliber;

an upper plate for attachment to the receiver and integral barrel assembly to form a caliber exchange unit, the upper plate including a recoil lug port at a front end of the upper plate for receiving a recoil lug disposed on the receiver;

a recoil extension attached to the upper plate and spaced from the recoil lug port; and a lower plate for bedding with a rifle stock and including a recoil extension receptacle at a front end of the lower plate for receiving the recoil extension such that the recoil extension spaces the caliber exchange unit from the lower plate when the recoil extension and the recoil receptacle are engaged at a point on the rifle stock forward of the rifle stock forward action screw port.

9. The caliber exchange system of claim 8, wherein the lower plate includes a housing for a trigger mechanism for allowing the trigger mechanism to separate from the receiver when the caliber exchange unit is detached from the lower plate.

10. The caliber exchange system of claim 8, wherein the upper plate comprises a forward attachment point disposed forward of the recoil lug port.

11. The caliber exchange system of claim 10, wherein the forward attachment point is centered approximately at a center of the recoil extension receptacle.

12. The caliber exchange system of claim 8, wherein the upper plate comprises first and second spaced apart screw ports spaced from the recoil lug port for attaching the upper plate to the receiver to form the caliber exchange unit.

13. The caliber exchange system of claim 8, further comprising a tail hook top fastened to a rear end of the caliber exchange unit and a tail hook bottom attached to a rear end of the bottom plate, the tail hook top and tail hook bottom engaging when the caliber exchange unit is attached to the lower plate.

14. A rifle comprising:

a rifle stock;

a lower plate fastened to the rifle stock including a recoil extension receptacle at a front end of the lower plate; and a caliber exchange unit comprising a receiver and integral barrel assembly of a selected caliber and an attached upper plate, the upper plate having a recoil lug port at a front end of the upper plate for receiving a recoil lug and a recoil extension spaced from the recoil lug port, wherein the recoil extension is operable to engage the recoil extension receptacle of the lower plate allowing the caliber exchange unit and the lower plate to be selectively attached and detached, wherein the upper plate includes a forward attachment point disposed forward of the recoil lug port for fastening the upper plate to the lower plate such that the barrel of the integral receiver and barrel assembly floats.

15. The rifle of claim 14, wherein the recoil extension of the upper plate floats the upper plate such that the caliber exchange unit is spaced from the lower plate when the recoil extension and the recoil receptacle are engaged.

16. The rifle of claim 14, further comprising a trigger mechanism received in a housing defined in the lower plate such that the trigger mechanism engages with the receiver when the caliber exchange unit is attached to the lower plate and separates from the receiver when the caliber exchange unit is detached from the lower plate.

* * * * *